US007707944B2

(12) United States Patent
Bounds

(10) Patent No.: US 7,707,944 B2
(45) Date of Patent: May 4, 2010

(54) METHOD AND APPARATUS FOR APPLYING RAILWAY BALLAST

(75) Inventor: Ivan E. Bounds, Lake Havasu City, AZ (US)

(73) Assignee: Herzog Contracting Corp., St. Joseph, MO (US)

( * ) Notice: Subject to any disclaimer, the term of this patent is extended or adjusted under 35 U.S.C. 154(b) by 0 days.

(21) Appl. No.: 11/566,484

(22) Filed: Dec. 4, 2006

(65) Prior Publication Data

US 2007/0129858 A1 Jun. 7, 2007

Related U.S. Application Data

(62) Division of application No. 10/870,843, filed on Jun. 17, 2004, now Pat. No. 7,152,347.

(51) Int. Cl.
*E01B 29/00* (2006.01)
*B61L 1/02* (2006.01)

(52) U.S. Cl. ..... 104/5; 246/127

(58) Field of Classification Search ..... 104/2, 104/5, 8, 88.01; 105/239, 240, 241.2, 247; 701/19; 246/125, 126, 127
See application file for complete search history.

(56) References Cited

U.S. PATENT DOCUMENTS 3,971,454 A 7/1976 Waterbury
4,065,856 A * 1/1978 Waters ..... 33/287
4,155,085 A * 5/1979 Warnock et al. ..... 342/182
4,781,119 A 11/1988 Davis
4,835,537 A 5/1989 Manion
4,863,123 A * 9/1989 Bernard et al. ..... 246/122 R
5,129,605 A 7/1992 Burns et al.
5,225,842 A 7/1993 Brown et al.
5,259,337 A 11/1993 Rasmussen
5,284,097 A * 2/1994 Peppin et al. ..... 104/88.02
5,359,942 A 11/1994 Ward
5,387,858 A 2/1995 Bender et al.
5,390,125 A 2/1995 Sennott et al.
5,574,469 A 11/1996 Hsu
5,657,700 A 8/1997 Bounds
5,684,385 A 11/1997 Guyonneau et al.
5,703,468 A 12/1997 Petrillo
5,714,948 A 2/1998 Farmakis et al.
5,768,128 A 6/1998 Thompson et al.
5,809,448 A 9/1998 Gimenez et al.
5,835,377 A 11/1998 Bush
5,850,620 A 12/1998 Skotnikov et al.
5,867,122 A 2/1999 Zahm et al.

(Continued)

FOREIGN PATENT DOCUMENTS

RU 2007693 C1 2/1994

(Continued)

*Primary Examiner*—S. Joseph Morano
*Assistant Examiner*—Robert J McCarry, Jr.
(74) *Attorney, Agent, or Firm*—Husch Blackwell Sanders LLP

(57) ABSTRACT

A method and apparatus for spreading ballast along railways makes use of an inertial measurement system to determine where to apply ballast from a hopper car. A variety of techniques can be used to determine the location and speed of the ballast spreading train, including manual or automated visual techniques, laser technology, radar technology, radio frequency transponders, magnetic sensor, thermal imaging and aerial photogrammetry. The invention also contemplates "on the fly" surveys and terrain profiling using lasers or radar.

2 Claims, 22 Drawing Sheets

U.S. PATENT DOCUMENTS

| | | | | |
|---|---|---|---|---|
| 5,904,296 | A * | 5/1999 | Doherty et al. | 239/61 |
| 6,027,053 | A | 2/2000 | Anderson et al. | |
| 6,058,628 | A | 5/2000 | Theurer et al. | |
| 6,092,745 | A | 7/2000 | Seymour et al. | |
| 6,161,986 | A | 12/2000 | Smith et al. | |
| 6,526,339 | B1 * | 2/2003 | Herzog et al. | 701/19 |
| 6,704,626 | B1 * | 3/2004 | Herzog et al. | 701/19 |
| 6,758,147 | B2 | 7/2004 | Howard et al. | |
| 6,768,551 | B2 | 7/2004 | Mian et al. | |
| 7,164,975 | B2 * | 1/2007 | Bidaud | 701/19 |
| 2004/0046546 | A1 | 3/2004 | Kishida | |
| 2005/0211903 | A1 * | 9/2005 | Harter, Jr. | 250/353 |

FOREIGN PATENT DOCUMENTS

| | | | |
|---|---|---|---|
| RU | 2150545 | C1 | 6/2000 |
| RU | 2181680 | C2 | 4/2002 |
| RU | 26505 | U1 | 12/2002 |
| RU | 2211785 | C1 | 9/2003 |
| RU | 2258909 | C2 | 8/2005 |

* cited by examiner

METHOD AND APPARATUS FOR APPLYING RAILWAY BALLAST

CROSS-REFERENCE TO RELATED APPLICATIONS

This application is a divisional of and claims priority to U.S. patent application Ser. No. 10/870,843, filed on Jun. 17, 2004 now U.S. Pat. No. 7,152,347, which application is hereby incorporated by reference to the extent permitted by applicable law.

STATEMENT REGARDING FEDERALLY SPONSORED RESEARCH OR DEVELOPMENT

Not applicable.

BACKGROUND OF THE INVENTION

Conventional railroads in the United States and elsewhere are typically formed by a compacted sub-grade, a bed of gravel ballast, wooden cross-ties positioned upon and within the ballast, and parallel steel rails secured to the ties. Variations of construction occur at road and bridge crossings and in other circumstances. The ballast beneath and between the ties stabilizes the positions of the ties, keeps the rails level, and provides some cushioning of the composite structure for loads imposed by rail traffic. Vibrations from the movement of tracked vehicles over the rails and weathering from wind, rain, ice, and freeze and thaw cycles can all contribute to dislodging of some of the ballast over time. Thus, in addition to other maintenance activities, it is necessary to replace ballast periodically to maintain the integrity and safety of railroads.

Ballast has been spread in the past using specially designed ballast hopper cars which include a hopper structure holding a quantity of ballast, a ballast chute communicating with the hopper, and a power operated ballast discharge door in the chute. The door can be controlled to selectively open or close to control the discharge of ballast. In some designs, the discharge door can be controlled to open outboard toward the outside of the rails, to close, or to open inboard toward the inside between the rails. Typical ballast hopper cars have a front hopper and a rear hopper, and each hopper has two transversely spaced doors, one to the left and one to the right. Thus, each hopper door can be controlled to discharge ballast outside the rails on the left and/or the right or between the rails. A typical configuration of a ballast hopper car is described in more detail in U.S. Pat. No. 5,657,700, which is incorporated herein by reference.

Ballast spreading has most often been controlled manually in cooperation with human spotters who walk alongside the moving ballast cars to open or close the ballast doors as necessary. A more recent ballast spreading control technique is by the use of a radio linked controller carried by an operator who walks alongside the moving ballast cars. Both conventional control methods are slow and thus disruptive to normal traffic on the railroad section being maintained, thereby causing delays in deliveries and loss of income.

U.S. Pat. No. 6,526,339 to Herzog, et al. generally discloses methods for spreading railroad ballast with location control based on data received from the global positioning system or GPS. The GPS system, is a "constellation" of satellites traveling in orbits which distribute them around the earth, transmitting location and time signals. As process the signals and triangulate position coordinates accurate to about ten to twenty meters. Current generations of commercially available GPS receivers, using differential GPS techniques, are able to achieve accuracies in the range of one to five meters. Such accuracy is adequate for depositing ballast where desired and inhibiting the deposit of ballast where it is not desired. Additional information regarding the development of GPS technologies can be obtained from U.S. Pat. No. 4,445,118 and U.S. Pat. No. 5,323,322. Development of the GPS system referred to herein was sponsored by the United States government. However, satellite based positioning systems developed or operated by other nations are also known.

Because railroad companies typically maintain hundreds or thousands of miles of track on a recurring schedule, the ballast replacement component of track maintenance alone can be a major undertaking in terms of equipment, materials, traffic control, labor, and management. Implementation of a GPS based system of the type disclosed in U.S. Pat. No. 6,526,339 can increase the accuracy and efficiency of ballast application on railways, however, the use of other techniques for controlling the application of ballast can be as good as GPS techniques and, in some applications, even better in some respects.

SUMMARY OF THE INVENTION

The present invention provides methods and apparatus for controlled spreading of ballast on a railroad on a large scale basis using multiple ballast hopper cars spreading simultaneously, at times. The system of the present invention uses various different techniques for determining where ballast needs to be applied and for controlling the opening of ballast doors to spread controlled quantities of ballast on sections where ballast is desired and to inhibit spreading ballast where not desired or not needed. The system allows the ballast train to spread ballast mostly at a high enough speed that normal traffic on the railroad on which it is operating is only minimally affected by its presence.

In practice of the present invention, a ballast train may include one or more locomotives, a control car (not required), and one or more ballast hopper cars, such as fifty hopper cars. Each hopper car may have two hoppers, left and right ballast chutes for each hopper, a ballast door for each chute, and a hydraulic actuator for each door. The actuator can be controlled to open its associated door to an inboard direction, between the rails, or to an outboard direction, outside of the rails. Each hopper can hold a known load of a particular type of ballast, and the average flow rate of a given type of ballast through a ballast door is also known. Each hopper car has car logic circuitry, referred to as a car control unit or CCU and also as a microprocessor control system, which controls operation of the hydraulic actuators and which monitors certain functions on the car.

The CCU's communicate with a network control unit or head end controller (HEC) through a network including a bus referred to at places herein as a "wireline". The bus extends from the HEC through the CCU of each car. The HEC may be a general purpose type of computer, such as a laptop, and it can have a differential GPS receiver interfaced thereto to provide geographic coordinates. The relative location of each ballast door on each hopper car of the train will be determined in relation to a known reference location. Ordinarily, the ballast train will use a plurality of virtually identical hopper cars with known distances between the ballast doors on a given car and between the ballast door of one car and the next adjacent car.

In order to control the spreading of ballast on a length of track, it is necessary to obtain the geographic location of the track. This is most conveniently accomplished by a rails, such as a Hy-Rail vehicle (trademark of Harsco Technologies Corporation). The track survey vehicle may be equipped with a suitable instrument for determining the location and with a computer, which may be the HEC computer, and track survey software. As the survey vehicle travels along the track, the survey crew, which may be or include a "roadmaster", marks spread zones where ballast is to be spread and non-spread zones, such as bridges, road crossings, and the like, where ballast is not to be spread. The location of the spread and no-spread zones are recorded by the instrument, which can take a variety of different forms.

Alternatively, other procedures for determining the spread and non-spread coordinates are foreseen. For example, if a previously obtained track coordinate data file is available, it is foreseen that it could be processed to designate spread and non-spread zones. Further, under some circumstances, track surveying may even be conducted on a ballast train, forward of concurrent ballast spreading activity. Under normal circumstances of pre-spread surveying, a track survey data file is created which is transferred to the HEC computer for processing during a ballast spreading run.

In addition to surveying the track for its coordinates to thereby locate zones requiring ballast and those on which ballast is not desirable, it is necessary to survey the ballast train for car identities car order, and car orientation. Each car control unit or CCU includes a designated front Discrete Auto-Manifest (DAM) relay and a designated rear DAM relay, both of which are normally inactive. These discrete lines are independent control lines residing within the interconnecting wireline cable that connects each car to the network. The hopper cars can be assembled into the ballast train in any random order and with some cars oriented front to rear while the rest are oriented rear to front. It is not economically feasible to assemble the ballast train in any particular order or to charge the orientation of any particular car. However, the HEC must determine the order and orientation of the cars to enable communication of ballast door commands to the proper car during ballast spreading.

In the process of surveying the CCU's of the hopper cars, the HEC may query the CCU's to report their identities or neuron identification numbers. Then, through an iterative procedure of commanding the cars to open their front and then rear DAM relays and report their identities, the HEC can determine the order of the cars and their orientations. In particular, after the identities are determined, the HEC may broadcast a command for a selected car to activate it's front DAM relay. Then the HEC may call for any cars that see a DAM line active to identify itself. The same car is then instructed to activate its rear DAM relay and the interrogation is repeated. This process is repeated using the cars that responded to the previous interrogations until all cars are linked together. The data file of identified, ordered, and oriented hopper cars is stored as the manifest data file.

The spreading of ballast may be controlled in terms of the amount or weight of ballast spread per unit of track length. From historic experience and for accounting purposes, the required quantity of ballast may be determined in tons per mile. While such a scale is more convenient for determining the cost of the operation, it is too coarse for dynamic control of ballast spreading at a relatively high traveling speed. The track length may be divided into "buckets" which are "filled" to achieve an overall desired tons of ballast per mile. The length of the buckets may be any convenient length and may be set at one foot lengths of track, for example. Each ballast door can spread either to the inboard side or the outboard side, and both can be effected at the same time. Each bucket has designated coordinates which may include the GPS coordinates of a set of buckets along with a sequential member of such a set. The bucket coordinates are derived by processing a previously generated track survey file.

The spreading process tracks the current location of the ballast train reference point in terms of its "bucket" location, the current load of ballast in each car, the fill percentage of each bucket, the state of each door as closed or opened and in which direction, and the speed of the train. Because of the lag in response of the ballast door actuators and the movement of the ballast and because of the movement of the train, the spreading process may "look ahead" in order to effectively correlate a door state to a given bucket. The spreading process can be timer driven and begins executing a series of actions at each timer interval or "tick". The timer interval may be at 100 milliseconds or one tenth of a second. Spreading actions are affected by the speed and location of the train and, thus, all calculations factor in the speed and location. In contrast, the flow rate of ballast through a ballast door can generally be considered to be a constant. Preferably, the ballast doors are operated in such a manner as to be considered fully closed or fully open; however, the present invention foresees the capability of operating with the ballast doors in partially open states and the use of flow sensors.

At each clock tick, the state of each ballast door in succession can be checked along with a "lookahead" set of buckets and, if the door is currently open, the fill percentage of a current bucket or set of buckets which will receive ballast from the door in the current time interval. If the door is closed, the state of the lookahead bucket set is checked to determined if opening the current door will exceed the target fill of those buckets. If not, the current door is opened. If the current door is already open, the fill percentages of the current bucket set are updated, and the lookahead bucket set is checked to determine if the current fill exceeds the target fill. If not, the door stays open.

In general, the threshold to keep a door open is not as strict as the threshold to open a closed door. In zones where spreading is desired, it is preferable to spread somewhat more than the target fill than less. Subsequent maintenance activity involves crews who will properly position the ballast and tamp it into place. Thus, a small excess of ballast is preferable to an inadequate amount. However, in the case of a no-spread zone, any ballast which is deposited may constitute a hazard, such as on a road crossing, and may require a clean-up. For processing purposes, buckets in no-spread zones are initialized as full so that lookahead routines which encounter them always require the current door to close if open or to remain closed.

The spreading process may continue until all buckets of a spreading run are filled, all ballast from the hopper cars is exhausted, until the process is interrupted by a detected malfunction in the system, or until the operator shuts the process down for any reason. Ballast may be supplied from the forward most hopper cars initially, moving rearwardly as the ballast is exhausted from the forward cars. If functions on a hopper car are inoperative, the car is simply bypassed in processing, although it may be necessary to bridge the computer network across such a "dead" car. It is possible that some buckets, particularly near the end of a spreading run, will not be completely filled. Thus, it is desirable to save data representing the final state of any unfilled buckets for a future spreading run. It may also be desirable to save the final state of all buckets and hopper cars for record keeping and accounting purposes.

The present invention contemplates a variety of methods and apparatus for determining the location where ballast is to be spread along a railway bed and applying using a gyroscope for stabilization and one or more accelerometers for determining forward and angular momentums. This inertial system can be augmented using various position reference techniques to improve the overall accuracy and reliability.

Due to drift, a position reference must be re-established from time-to-time. Various methods and techniques can be used.

One example involves using fixed mile-markers that are typically installed along railways at one mile intervals or less. One way to use the markers is for a human operator to depress a button or otherwise record when each marker is reached. A controller can then recalibrate the distance and compute the speed of the railway vehicle. The controller can open ballast hopper doors when spread zone locations are reached and leave them open long enough to cover the entirety of each spread zone before the doors are closed. Alternatively, a visual recognition device such as a camera can use stored imagery of the railway to determine when known locations are reached by comparing current images with stored images of known locations.

Laser techniques can also be used. Laser beams reflected from known wayside reference locations can be received and used to calculate the distance to the reference locations and thus the current location of the train. The velocity can be computed based on the delay of the reflected signal and the frequency shift. These data can be used by the controller to open and close ballast doors properly to apply ballast to spread zones.

Law enforcement radar equipment can be employed and may have advantages in many applications. A radar signal directed at a wayside reference point can be received after detection and used to determine the distance from the reference location and the train speed, all using known techniques that are commonly used in law enforcement applications.

Radio frequency technology using either active or passive devices is another option. A radio transponder on the train can transmit rf signals to wayside devices which send response signals back to the onboard transponder. Location and speed data are thus acquired and used by the controller to apply ballast to the spread zones. Active devices at the wayside locations require external or battery power allowing them to function effectively at distances up to one mile or more. Passive wayside devices can use the energy from the signals they receive and are inexpensive, but their range is much more limited.

Magnetic sensing devices on board the train can sense either the presence of magnets placed along the railway bed at known locations or natural variations in the magnetic field of the earth at known locations. In either case, by magnetically detecting when the train reaches known locations, the location of the train relative to spread zones can be determined. By measuring the time between consecutive locations that are sensed magnetically, the current train speed is known so that control of the ballast hopper doors can be effected.

The present invention further contemplates thermal sensing to detect the current location and speed of the train. A thermal sensor on board the train can sense the current thermal characteristics of the earth along the rail bed and compare them with a known thermal profile to determine the current train position. Objects along the railway at known locations that can be detected thermally can also be used. Fixed objects such as engines, street lights, crossing signals and other wayside devices can be sensed as the train passes them.

The ballast condition along the railway bed can be profiled using a laser, radar or other instrument to create a profile map as a survey vehicle travels on the track. The current profile can be compared with a reference profile to detect when a zone is deficient in ballast and the location and amount of the deficiency. The controller can use this information to control the ballast doors in a manner to correct the deficiency.

The present invention additionally contemplates combining the steps of obtaining a survey and then applying ballast where needed in a separate operation. In this regard, a human operator on the ballast train can record when a spread zone is encountered and signal its location as well as the ballast requirements there. The controller then quickly adjusts the ballast door operation dynamically to apply the proper amount of ballast at each zone that is deficient.

Aerial photogrammetry techniques may also be employed in accordance with the invention, using satellite imagery or photogrammetry from manned or unmanned aircraft.

Other objects and advantages of this invention will become apparent from the following description taken in relation to the accompanying drawings wherein are set forth, by way of illustration and example, certain embodiments of this invention.

The drawings constitute a part of this specification, include exemplary embodiments of the present invention, and illustrate various objects and features thereof.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 1:
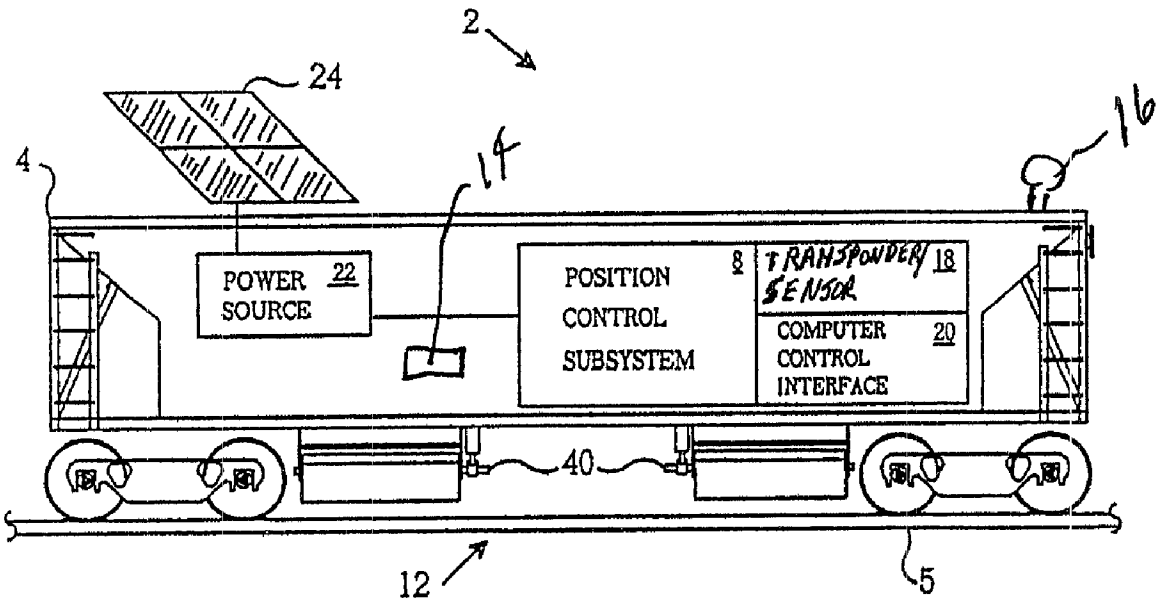
FIG. 1 is a diagrammatic view of a railway ballast spreading system embodying the present invention, shown implemented on a railcar.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a railway ballast application system embodying the present invention. The system 2 is also referred to herein as a ballast spreading system. Without limitation on the generality of useful applications of the system 2, it is shown installed on a ballast train 3 (FIG. 14) including a plurality of ballast hopper cars 4 for ballast spreading operations.

The system 2 may generally make use of an on-board position control subsystem 8, a hydraulic actuator subsystem 10, a ballast discharge mechanism 12 (FIG. 4), an inertial system 14, a GPS receiver 16 and a transponder/sensor system 18.

Figure 2:
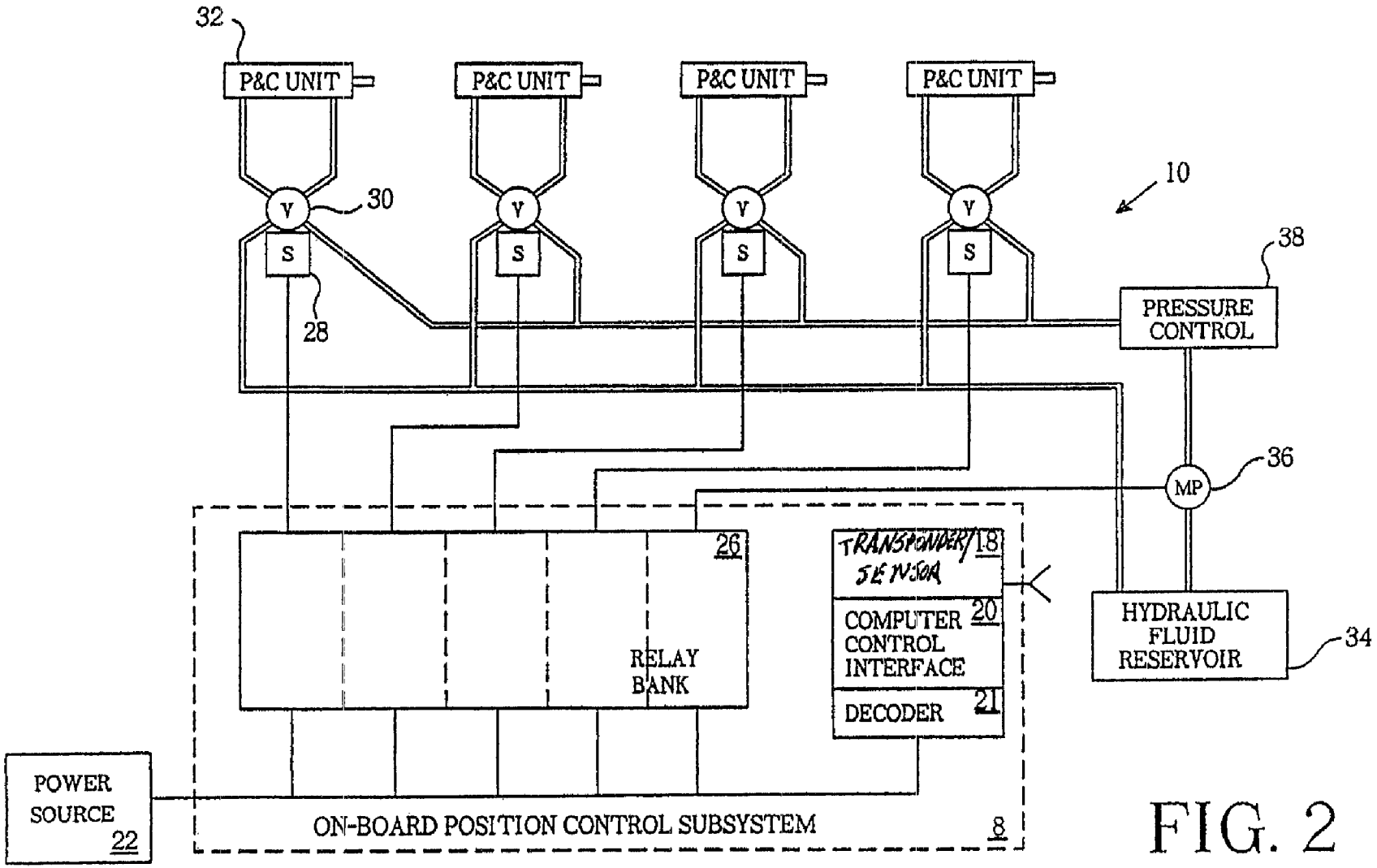
FIG. 2 is a diagrammatic view of a hydraulic actuator subsystem for operating ballast hopper doors of the ballast spreading system.

The on-board position control subsystem 8 (FIG. 2) is mounted on the railcar and operates with the transponder/sensor 18, which obtains location and speed data. The system 18 can include a variety of different types of devices, as will be described in more detail.

The system 18 is connected to a control computer 20 which receives positioning data signals from the system 18, processes same and interfaces with the actuator subsystem 10. The control computer 20, also referred to herein as a head end controller (HEC) can, for example, be a fairly conventional desktop or laptop type of personal computer, preferably with typical capabilities in currently available computers of this type.

The controller 20 includes decoder circuitry 21 which receives command signals addressed to specific hydraulic actuators or piston/cylinder units 32 in the actuator subsystem 10. The output of the decoder 21 is input to a relay bank 26 with multiple relays corresponding to and connected to respective components of the hydraulic actuator subsystem 10. The position control subsystem 8 is connected to a suitable, on-board electrical power source 22, which can utilize a solar photovoltaic collector panel 24 for charging or supplementing same. Alternatively, the power source 22 may be a conventional DC charging bus, as is found on conventional trains for powering electrical subsystems on railroad cars.

The hydraulic actuator subsystem 10 (FIG. 2) includes multiple solenoids 28 each connected to and actuated by a respective relay of the relay bank 26. Each solenoid 28 operates a respective hydraulic valve 30. The valves 30 are shifted between extend and retract positions by the solenoids 28 whereby pressurized hydraulic fluid is directed to the piston/cylinder units 32 for respectively extending and retracting same. The piston/cylinder units 32 can comprise two-way hydraulic units, pneumatic units, or any other suitable actuators. A hydraulic fluid reservoir 34 is connected to the valves 30 through a suitable motorized pump 36 and a pressure control 38.

Figure 3:
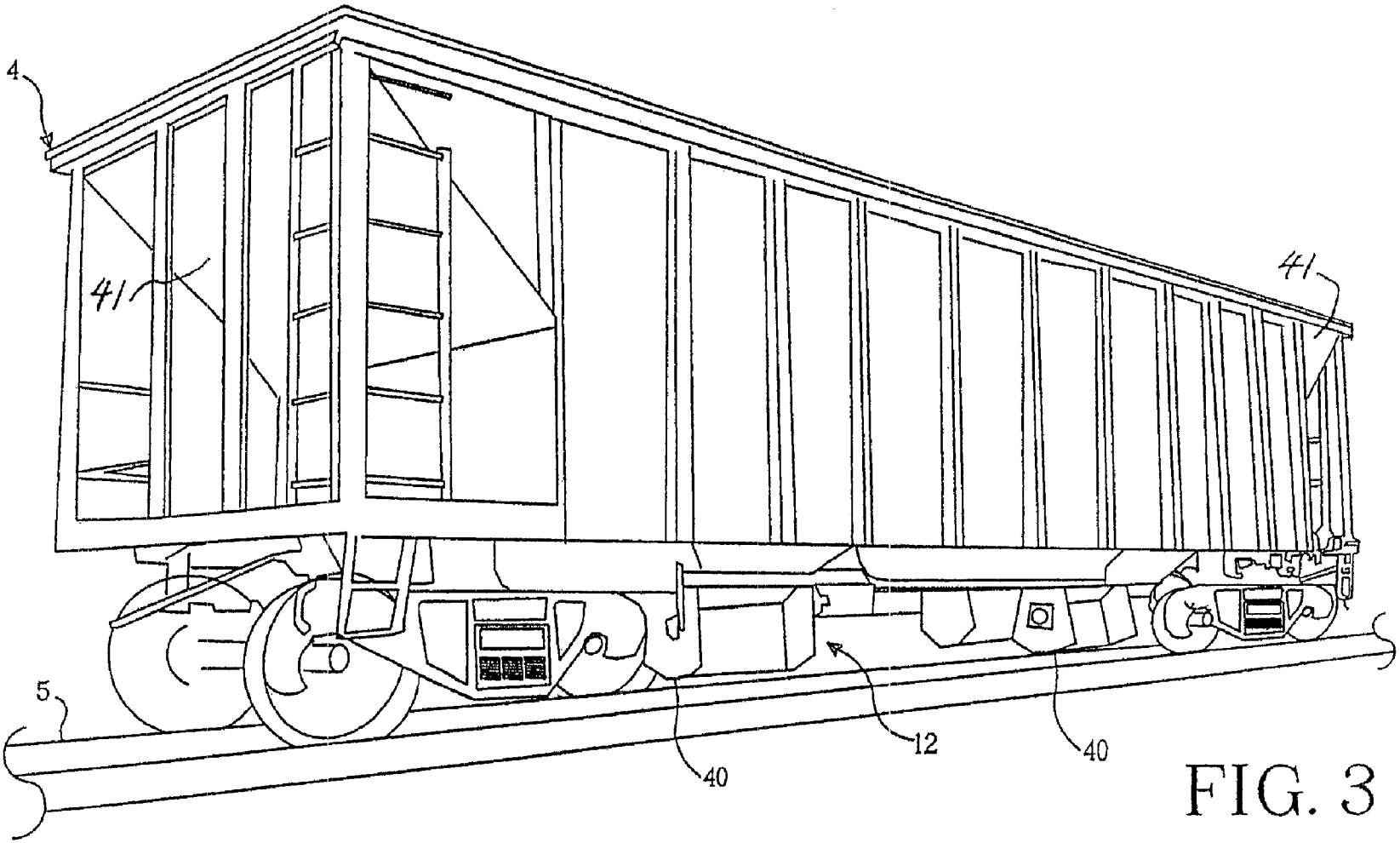
FIG. 3 is a perspective view of a ballast hopper car adapted for use in the present invention.
Figure 4:
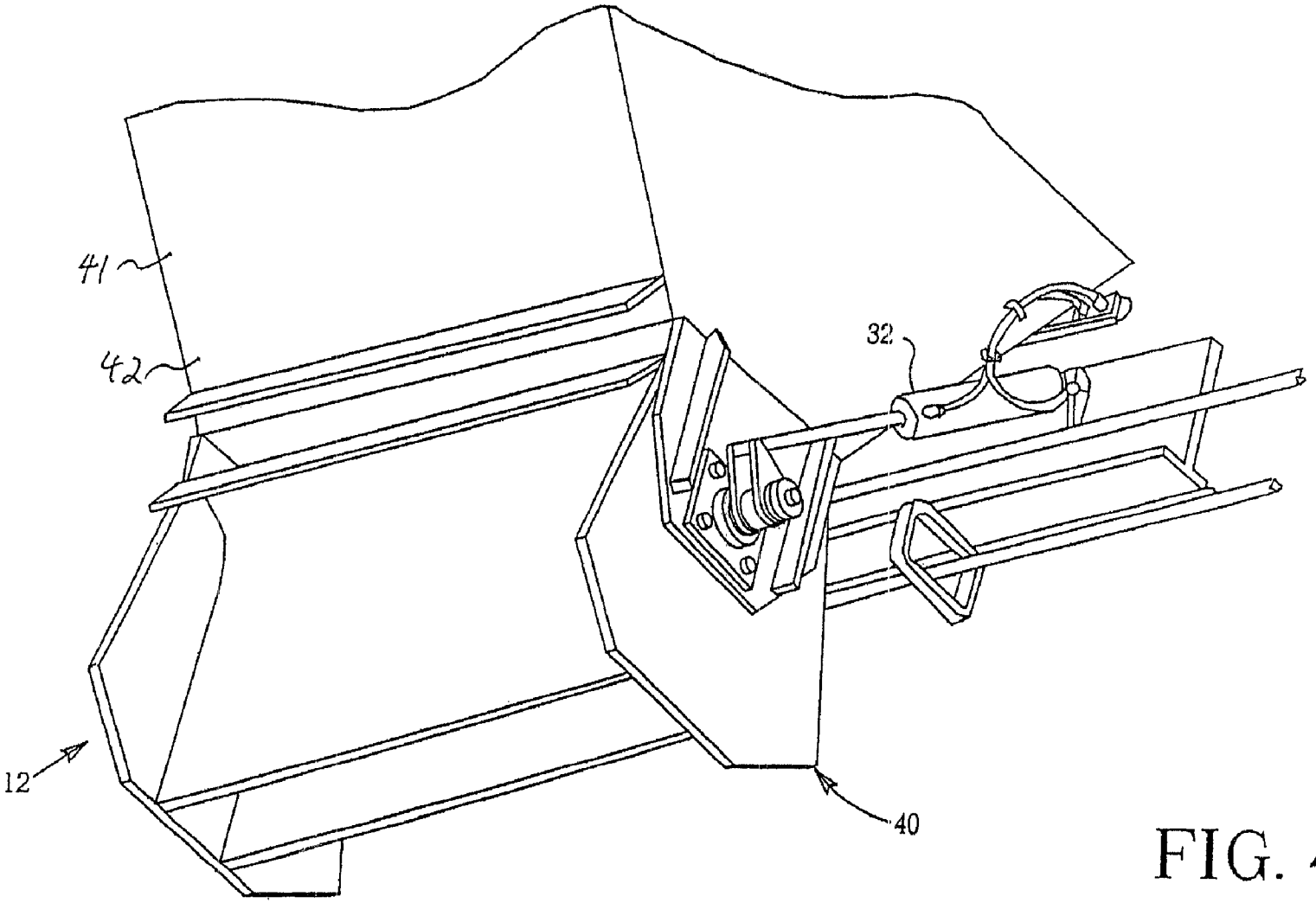
FIG. 4 is an enlarged fragmentary perspective view of a ballast discharge control mechanism including a ballast door and hydraulic actuator therefore thereof.

The ballast discharge mechanism 12 (FIG. 4) includes four hopper door assemblies 40 (up to eight can be employed) installed on the underside of the hopper car 4 and arranged two (or four) to each side. The ballast hopper car 4 includes front and rear hoppers 41 (FIG. 3), each with left and right discharge chutes 42 with in and out doors. A hopper door assembly 40 is installed at each discharge chute 42 and controls the flow of ballast 44 (FIG. 15) therefrom. The hopper door assemblies 40 discharge the ballast 44 laterally and are adapted to direct the discharge inboard (toward the center of a rail track 5 between the rails) or outboard (toward the outer edges of the rail track 5). A more detailed description of the construction and function of the hopper door assemblies 40 can be found in U.S. Pat. No. 5,657,700, which is incorporated herein by reference. As shown in FIG. 4, each hopper door assembly 40 is operated by a respective hydraulic actuator 32 for selectively directing the flow of ballast 44 therefrom.

As will be described in more detail below, the position control subsystem 8 is preprogrammed with various data corresponding to the operation of the logistic system 2. For example, discharge operations of the ballast discharge mechanism 12 can be programmed to occur at particular locations. Thus, ballast 44 can be applied to a particular section of rail track 5 by inputting the corresponding track coordinates and programming the position control subsystem 8 to open the hopper door assemblies 40 in the desired directions and for predetermined durations. The data obtained by the system 18 and used by the on-board position control subsystem 8 can provide relatively precise information concerning the position of the hopper car 4.

Figure 5:
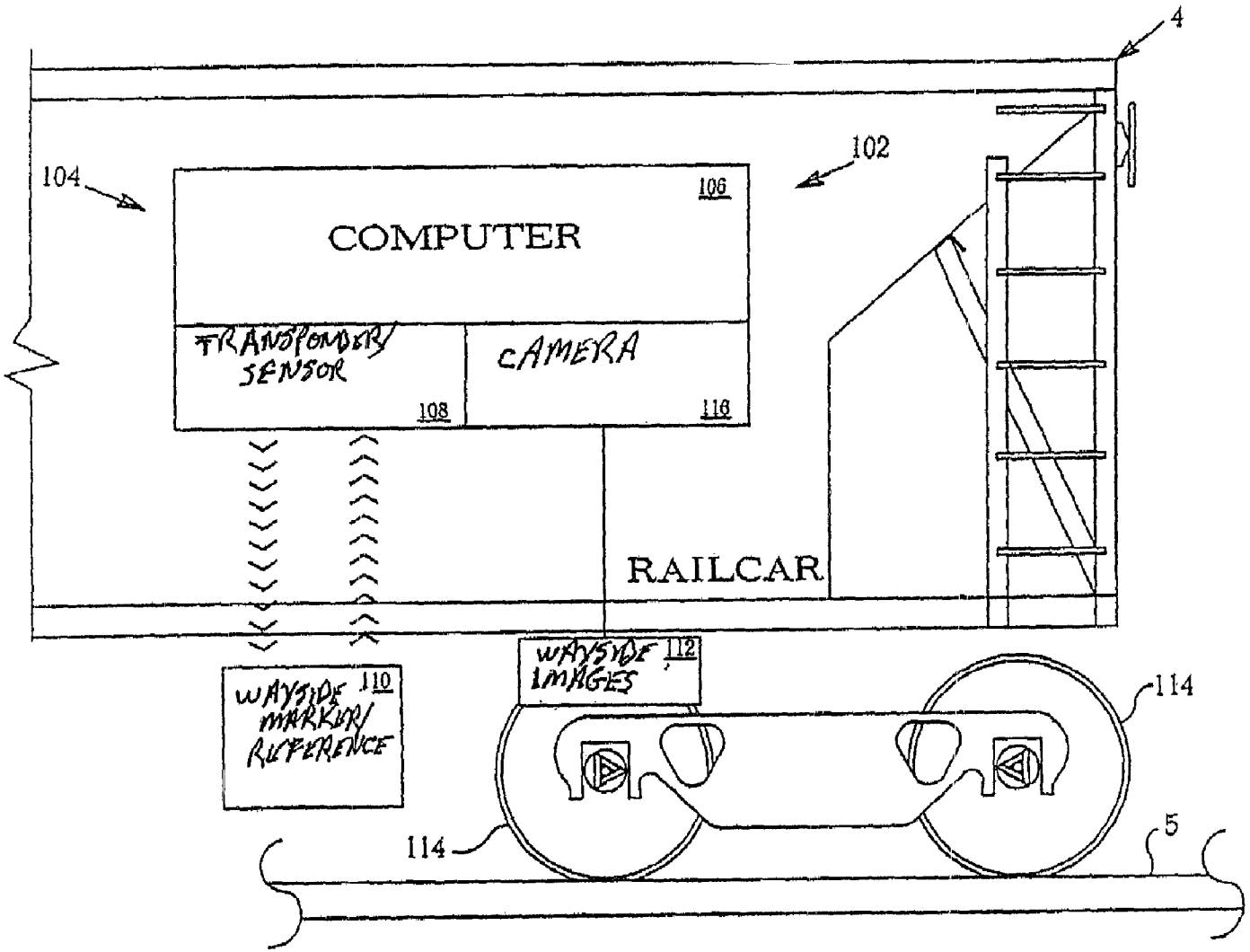
FIG. 5 is a fragmentary diagrammatic view illustrating principal components of an alternative embodiment of a position control subsystem for use in present invention.

The reference numeral 102 (FIG. 5) generally designates a ballast spreading control system using a position control subsystem 104. The position control subsystem 104 can comprise any suitable means for measuring the travel of a vehicle, such as the railcar 4, and/or detecting its position along the rail track 5 or some other travel path.

The position control system 104 include a computer 106 which may interface with a transponder or sensor 108 for detecting position markers 110. For example, the position markers 110 can be fixed wayside reference points located alongside the rail track 5 whereby the device 108 provides a signal to the computer 106 when the railcar 4 is positioned in proximity to a respective position marker 110. The position control subsystem 104 can alternatively include an image sensor such as a camera 116 which optically or visually senses wayside images 112. The computer 106 can interface with an hydraulic actuator subsystem 10, such as that described above, to control the discharge of ballast 44 therefrom in relation to the detected position.

The material applying or ballast spreading system described above is principally directed to controlling the material spreading activities of a single rail car under position coordinate control by a computer. Ballast spread by a single car, or several such cars, can provide some utility in relatively small operations, such as small scale maintenance operations. However, rail maintenance is often a very large undertaking, involving hundreds or thousands of miles of tracks on a recurring basis. The present invention is adaptable to such larger scale rail maintenance operations.

Figure 12:
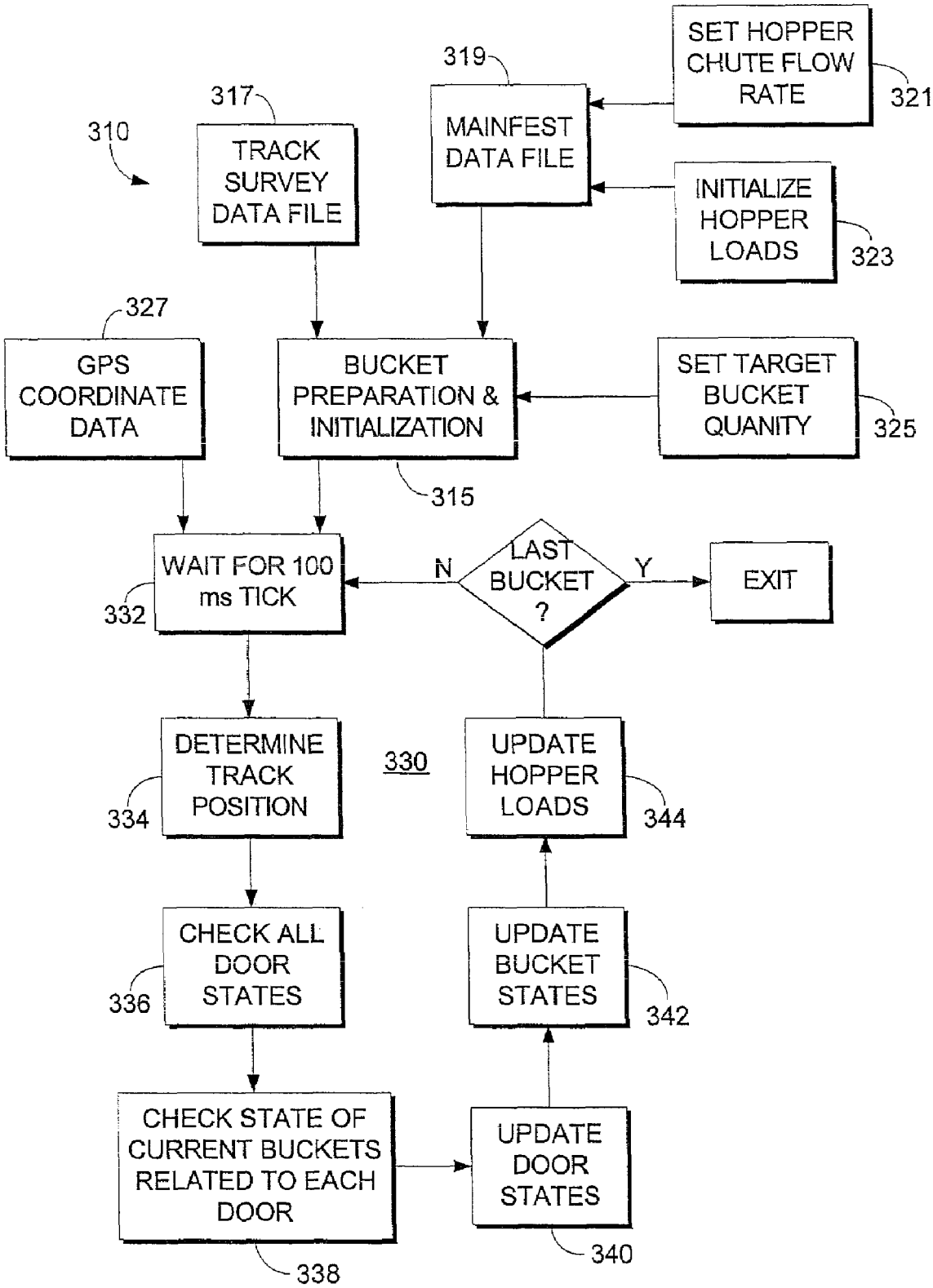
FIG. 12 is a flow diagram illustrating the principal functions of a ballast spreading control process of the present invention.
Figure 13:
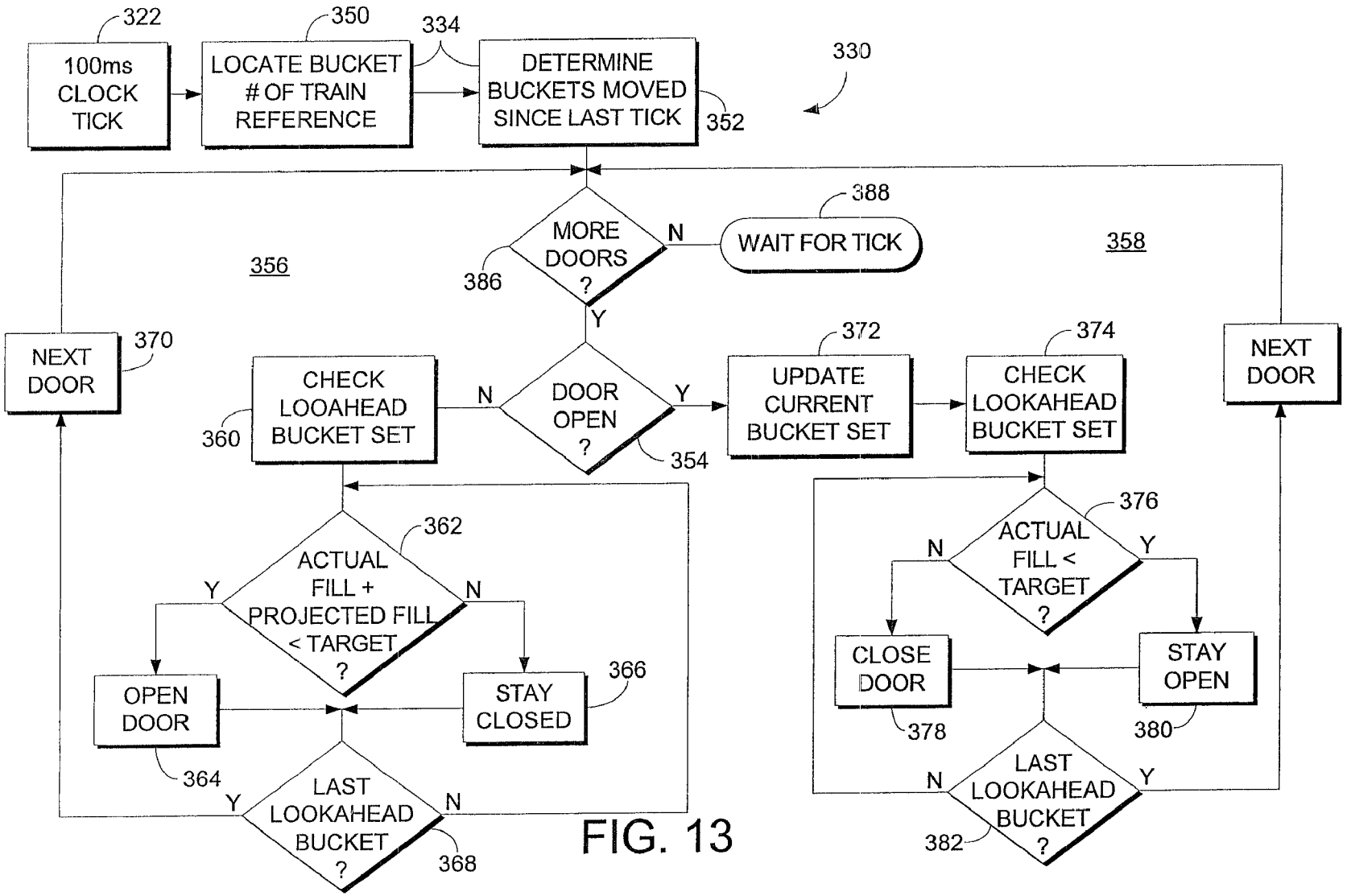
FIG. 13 is a flow diagram illustrating in more detail than FIG. 12 the principal functions monitored and actions taken in the ballast spreading control process of the present invention.
Figure 14:
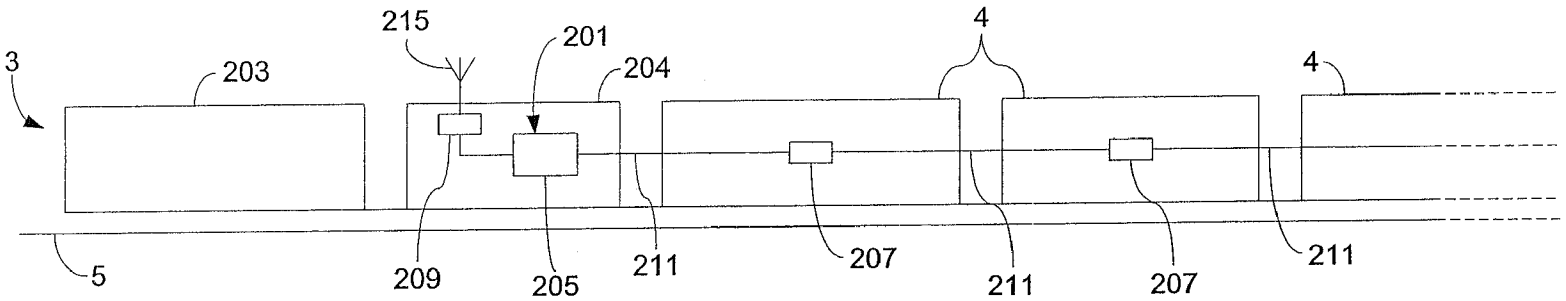
FIG. 14 is a diagrammatic representation illustrating a ballast train for use in practice of the ballast spreading system of the present invention.
Figure 15:
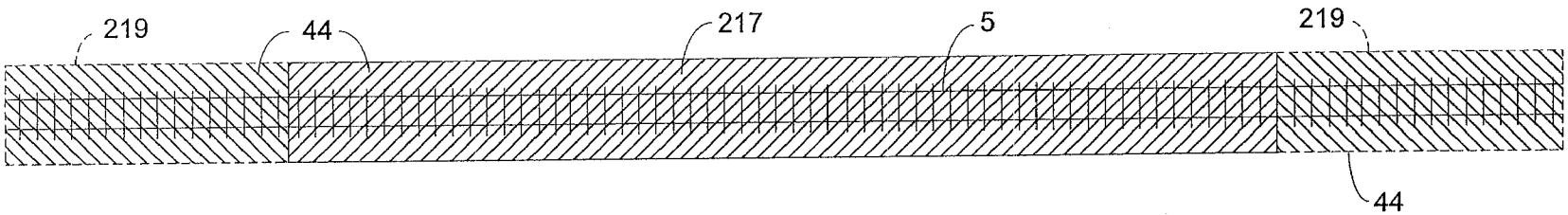
FIG. 15 is a diagrammatic representation illustrating a railroad track and spread sections intended to receive ballast spread by the present invention and no-spread sections which are not to receive such ballast.

FIGS. 6-15 illustrate an embodiment of the ballast spreading system 201 of the present invention. Referring to FIGS. 14 and 15, the system 201 includes a ballast train 3 including a locomotive 203, a control car 204 (optional), and a plurality of ballast hopper cars 4, as described above, positioned on a railroad track 5. A typical ballast train 3 may include up to 100 hopper cars 4. The system 201 includes a main computer or head end controller (HEC) 205, a plurality of car control units (CCU) 207, a location-detector 209, and a network 211 interconnecting the HEC 205 with the CCU's 207. The detector 209 is interfaced to the HEC 205 and provides a spatial reference of the ballast train 3. Referring to FIG. 15, the system 201 is adapted for controlled and coordinated spreading ballast 44 (represented by cross-hatching in FIG. 15) in spread zones 217 and inhibiting the spreading of ballast 44 in no-spread zones 219, according to positions detected by the detector 209.

The detector 209 outputs position data, such as latitude and longitude coordinates, in a format which can be further processed by the HEC 205.

The HEC 205 may be a desktop or laptop type of personal computer. Currently available personal computers based on Pentium III (Intel) or AMD Athlon (American Micro Devices) class of microprocessors, or better, are adequate for use as the HEC 205, although not specifically required.

The network 211 may be any suitable type of computer network to allow communication between the HEC 205 and the CCU's 207, and possibly the GPS receiver 215. In the system 201, the network 211 is preferably based on the Lontalk and Neuron components and protocols of Echelon Corporation of Palo Alto, Calif. The network 211 may be a relatively low bandwidth network since only low data density control commands, status reports, and the like are required to be carried. Alternatively, other types of networks and communication protocols may be suitable for use in the system 201.

Figure 6:
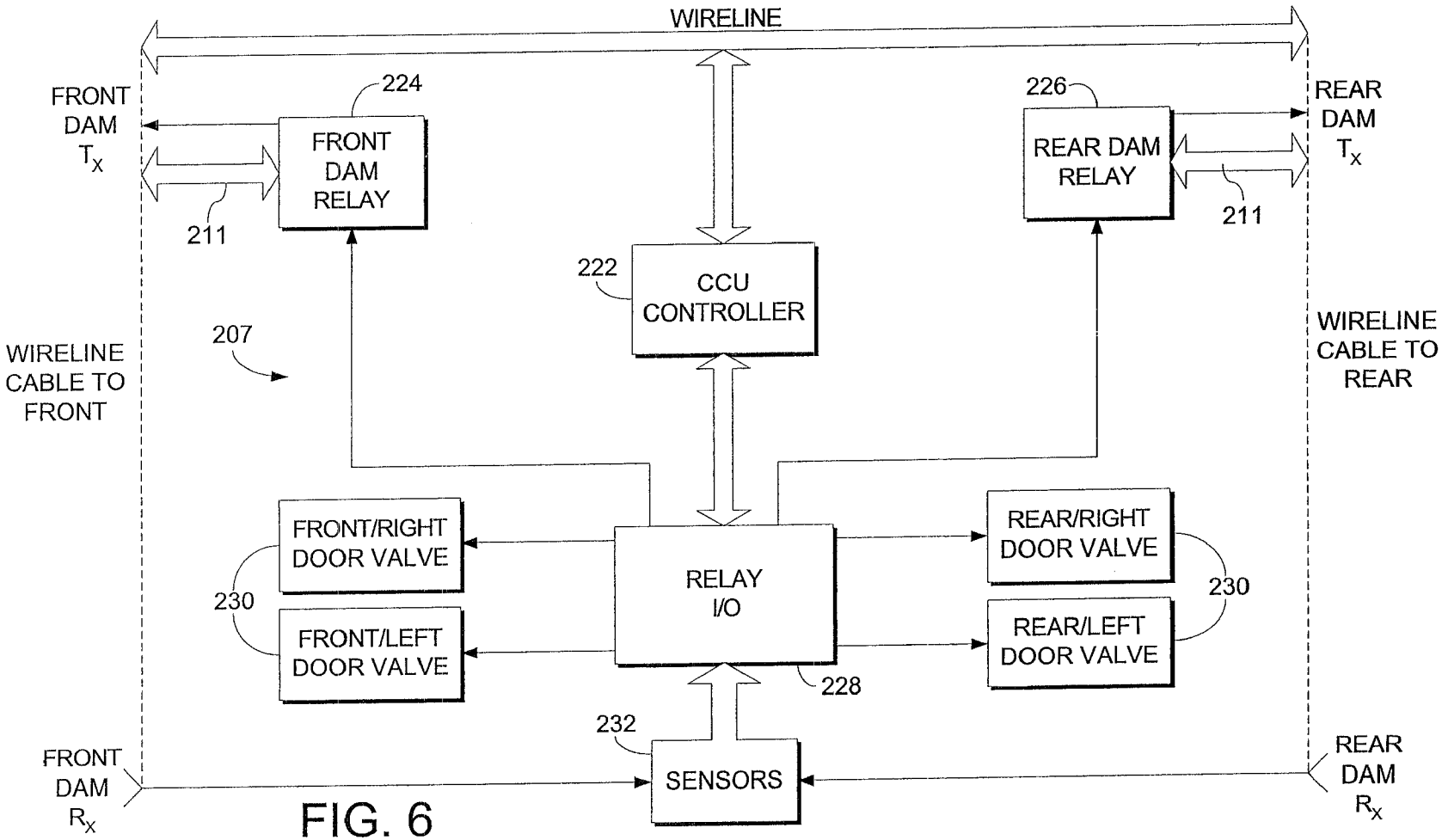
FIG. 6 is a block diagram illustrating principal components of a car control logic unit (CCU) which is installed on each hopper car of the present invention.

FIG. 6 illustrates further details of a typical car control unit or CCU 207. The CCU 207 includes a CCU controller 222 which may include a microprocessor or microcontroller in addition to other logic components and circuitry. The CCU controller 222 is connected by a parallel interface to the network bus 211. The CCU 222 is interfaced through the DAM Tx relays which activate sensor inputs in adjacent cars. The CCU controller 222 is also interfaced through relay input/output logic 228 to hydraulic valves 230 which control operation of the front and rear sets of right and left hydraulic actuators 32, which operate the ballast hopper doors 40. The relay I/O logic 228 may also receive inputs from sensors 232 on the car 4, such as DAM discrete inputs, door status switches, hydraulic pressure switches, and the like (not shown). As shown, the CCU controller 222 is interfaced through the relay I/O logic 228 to the car relays 224 and 226, also referred to as DAM relays, and is able to selectively close the relays 224 and 226 for a purpose which will be detailed further below.

The CCU controller 222 is programmed for certain automatic functions, such as "dead man" type functions wherein the CCU controller 222 causes the associated ballast doors 40 to close after a communication timeout in which no data communications are received by the CCU controller 222 from the HEC 205. This is a safety feature which causes the cessation of ballast spreading or prevents the initiation of ballast spreading in the event of loss of control communication.

Figure 7:
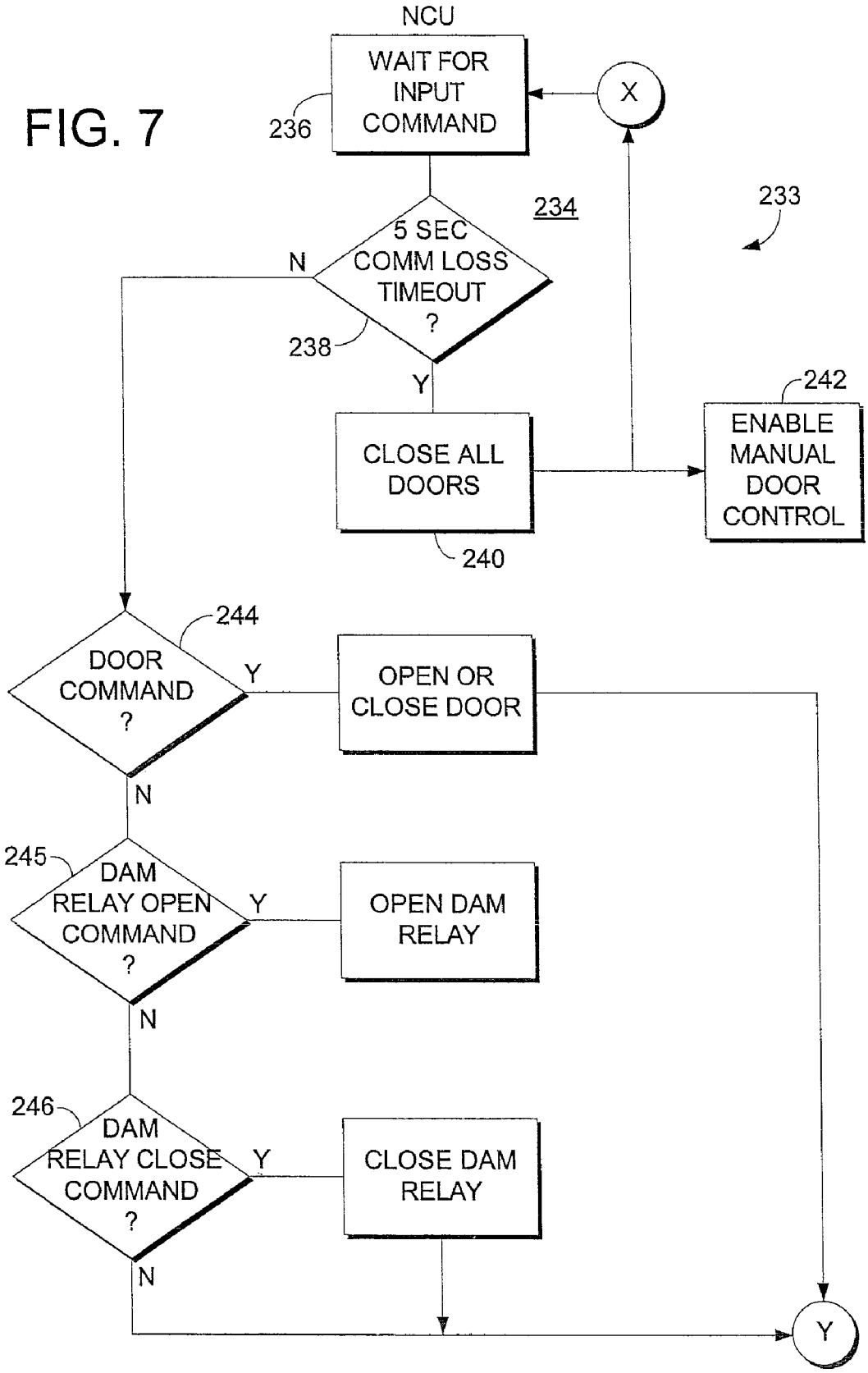
FIGS. 7, 8, and 9 are interrelated flow diagrams which illustrate respective portions of the principal control functions of the car control unit (CCU) present on each hopper car of the present invention.
Figure 8:
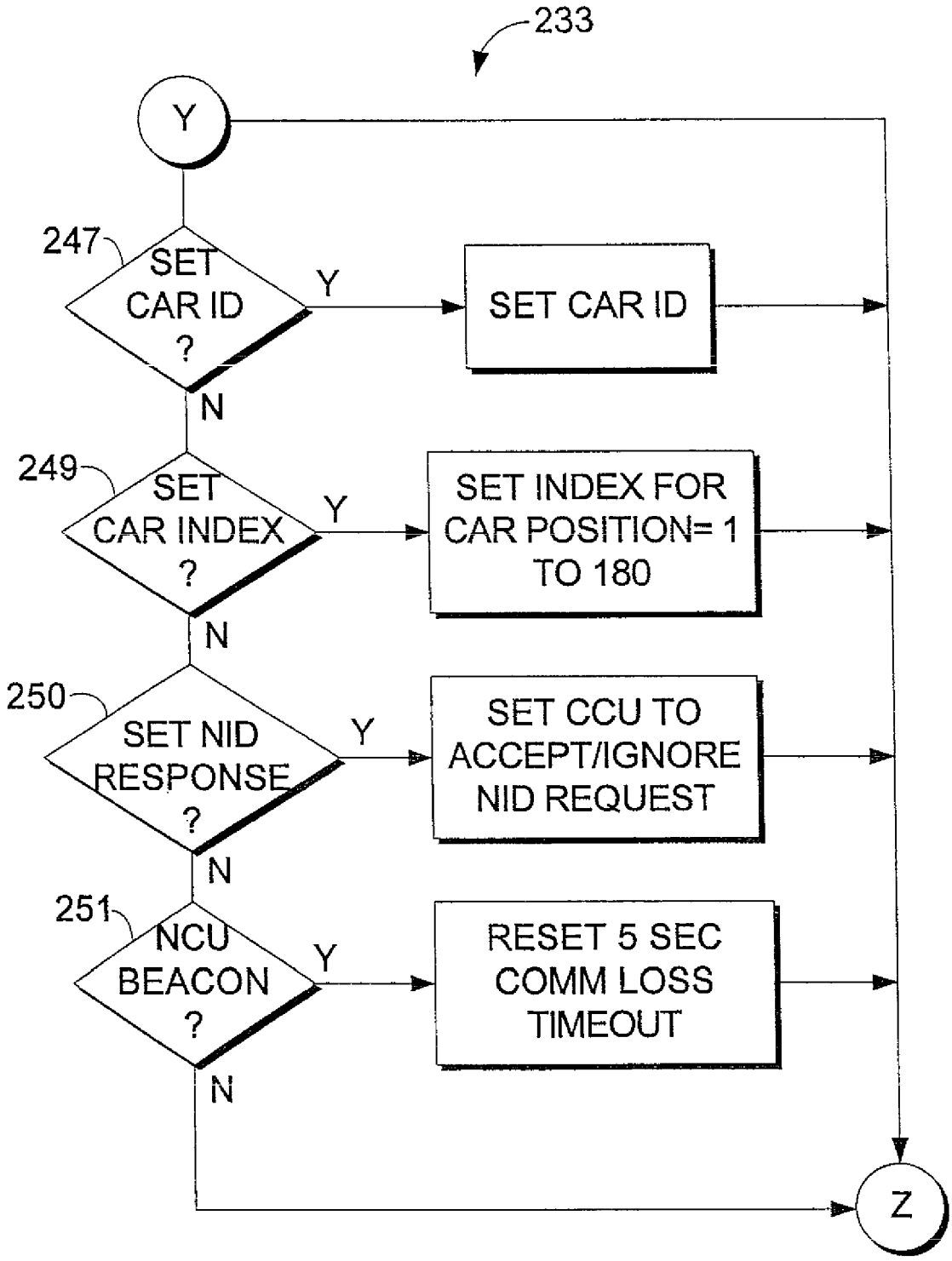
Figure 9:
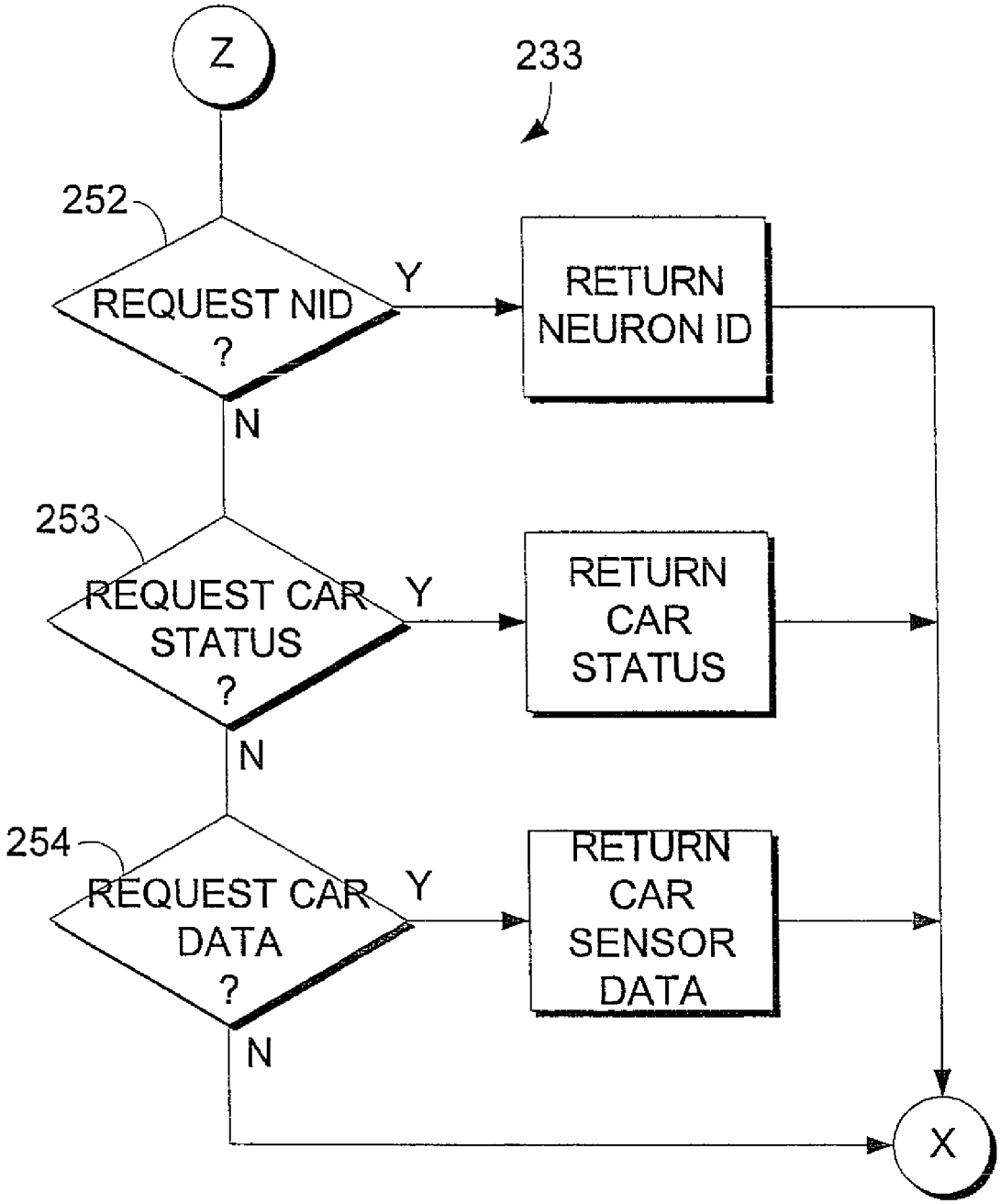

FIGS. 7, 8, and 9 illustrate the principal software functions 233 of the CCU controller 222. Referring to FIG. 7, a hopper car "dead man" loop 234 is shown in which the CCU 222 waits for any command from the HEC 205 at 236 for a two second communication timeout at 238. If no command is received, all ballast doors 40 are closed at 240, manual control of the doors 40 is enabled at 242, and control is returned to the wait function at 236 can process a door command at 244, a DAM or car relay open command at 245, a DAM relay close command at 246, a set car ID (identification) command at 247, a set car index command at 249, a set NID (Neuron ID) response command at 250, an HEC beacon command at 251, a request NID command at 252, a request car status command at 253, or a request car data command at 254. Although the commands 244 through 254 are shown in a sequence, the CCU controller 222 merely waits for one of the commands and processes it. Additionally, the connection or entry points X, Y, and Z are for graphic convenience.

Referring to FIG. 7, whenever the DAM relays 224 or 226 are closed, DAM input sensors on adjacent cars are activated. The car index command 249 is used set the sequential position of a car 4 on the ballast train 3. The HEC beacon command 251 is normally broadcast periodically to all cars CCU's 207 at an interval of less than the two second dead man timeout interval to maintain the status quo of all functions. Thus, if a CCU 207 receives no other commands, it will periodically receive the HEC beacon 251. The remaining CCU functions 233 are either self-explanatory or will be referred to in more detail below.

Figure 10:
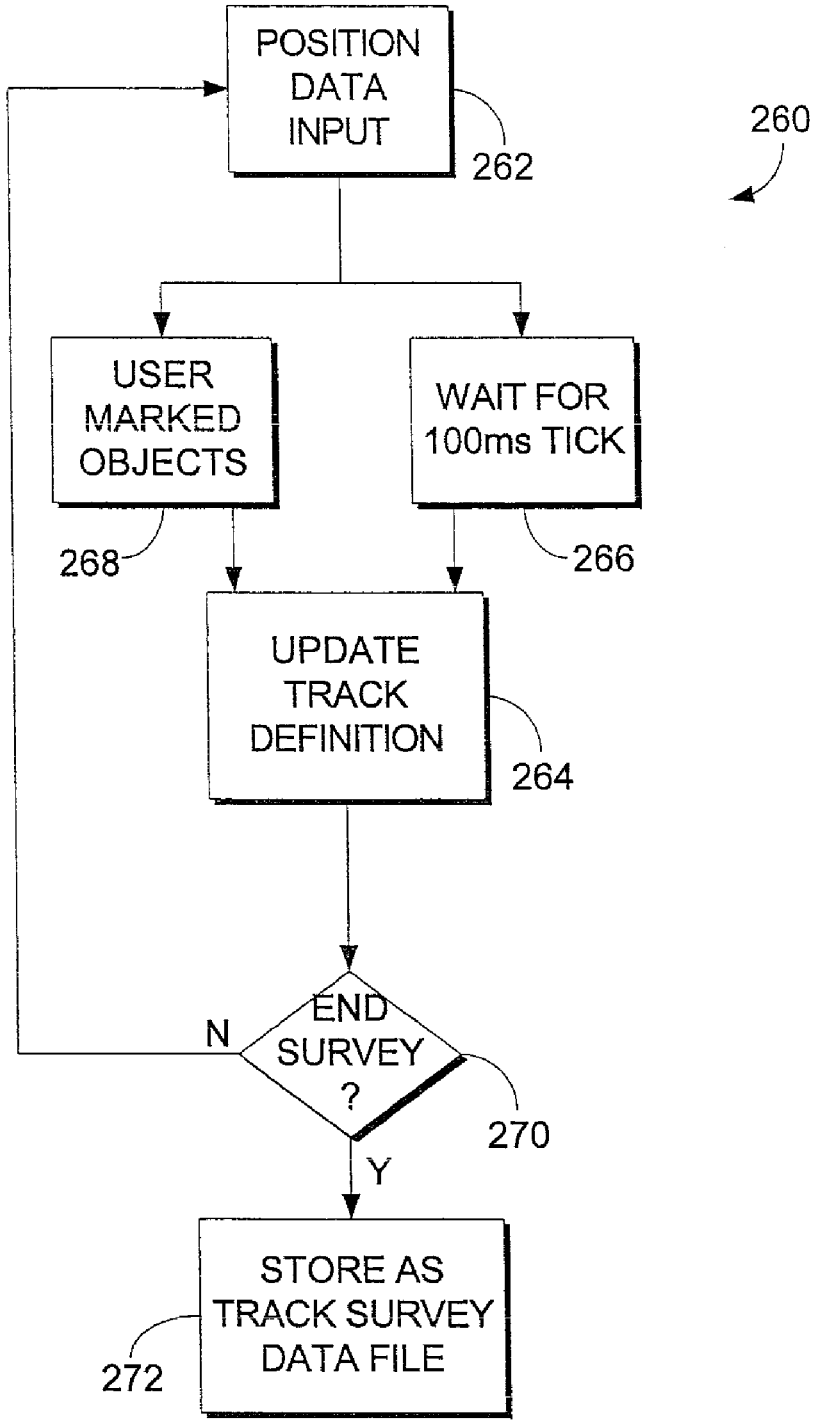
FIG. 10 is a flow diagram illustrating principal functions of a track survey routine of the present invention.
Figure 11:
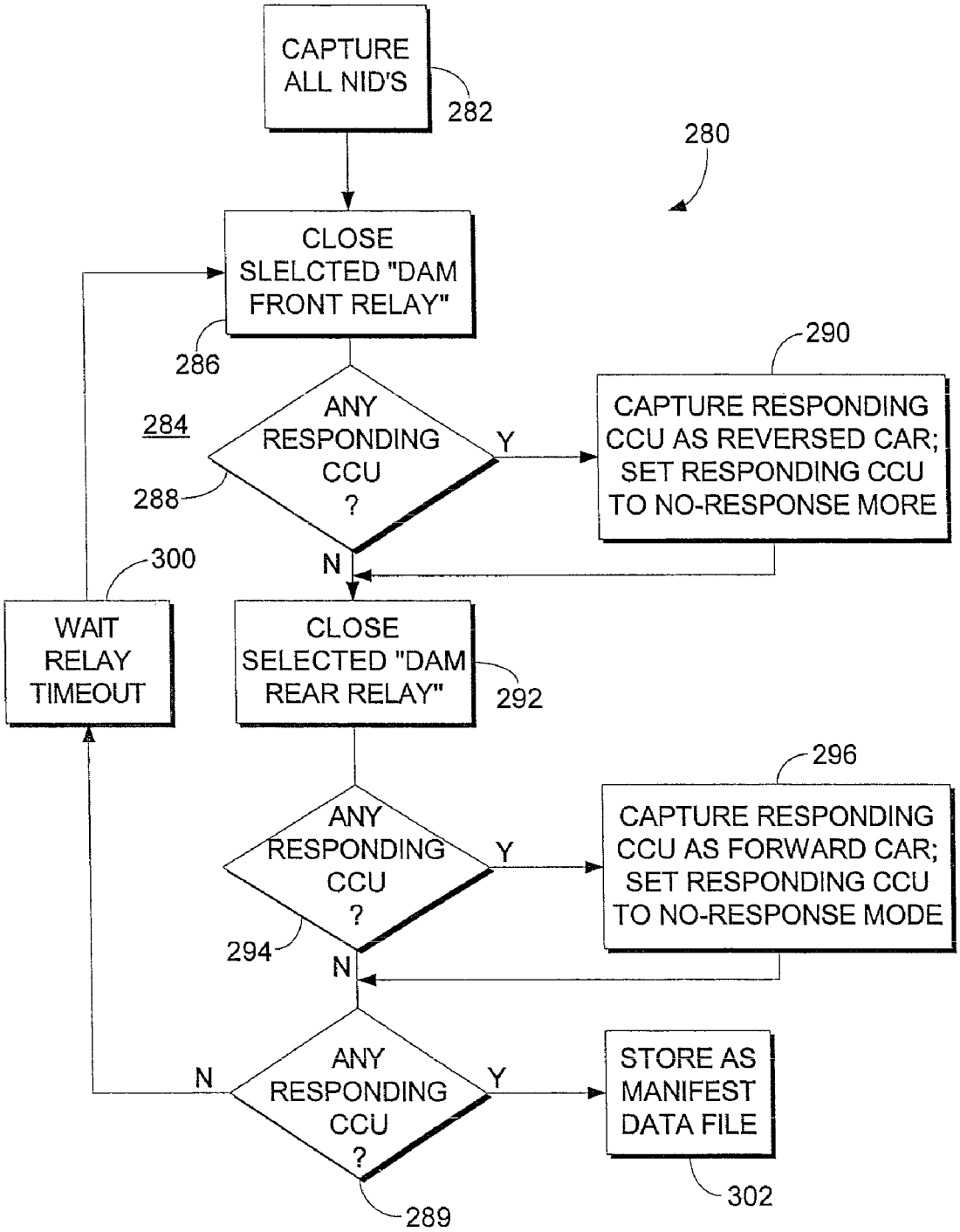
FIG. 11 is a flow diagram illustrating principal functions of a ballast train manifest routine of the present invention.

FIG. 10 illustrates a track survey process 260 for obtaining position coordinates for the spread zones 217 and no-spread zones 219 by surveying the track 5. The process 260 may be carried out, for example, using a small vehicle such as a Hy-Rail vehicle which is driven along the track 5 with a location detector and a computer, such as the detector 209 and HEC 205, on board. The process 260 receives position data at 262 from the detector 209 and updates the track definition data at 264 at 100 millisecond intervals determined by loop timer at 266. At any time, the roadmaster or other operator conducting the survey may toggle a switch to indicate a change from a spread condition to a no-spread condition at 268. The process 260 continues until it detects a command from the operator at 270 to end the survey process 260. At that time, the geographic coordinate data gathered is stored in a track survey data file at 272.

For the most part, the survey process 260 can gather all the required location data to conduct a ballast spreading run. In some circumstances, it may be necessary to conduct parts of the survey on foot to mark starting and ending locations of spread zones or no-spread zones. Additionally it may be necessary to mark some zones which are not appropriate for ballast spreading using the system 201. For example, if multiple transitions from spreading to non-spreading status would be required, there may not be enough time to cycle the hydraulic actuators 32 because of lags in hydraulic fluid supply. In such circumstances, it may be necessary to spread ballast on such a zone by more conventional techniques.

In order to control the individual ballast doors 40 of the cars 4, it is necessary for the HEC 205 to "know" the position of each door 40 relative to the reference point 215 and to be able to "talk" to or communicate with each individual hydraulic actuator 32. The system 201 includes a train manifest process 280 (FIG. 11) for querying the CCU's 207 to determine the order of the cars 4 and their forward or reversed orientation. The process 280 initially captures all the Neuron ID numbers (NID's) at 282 by broadcasting the request NID command 252 (FIG. 9). The first CCU 207 to respond is placed in a non-responsive mode by the set NID response command 250 (FIG. 9). The capturing routine 282 is repeated until no more responses are received. By the routine 282, the HEC 205 is able to identify all the cars 4 with functioning CCU's 207.

Next, a car sequence/orientation survey loop 284 is executed. In the loop 284, the front DAM relay 224 and rear DAM relay 226 are sequentially opened, checks made for any responding CCU's 207, and setting any responding CCU to a no response state. At 286, the command is broadcast to a selected CCU's to open their front DAM relay 224. A command for any CCU to respond at 288 is made. Any CCU which responds with its front DAM relay 224 closed is determined to be reversed. At step 290, the car 4 with the responding CCU 207 is designated as a starting point for manifest and as reversed in orientation and is set to the no-response mode. A test is made at 294 for any responding CCU. If so, the car 4 with the responding CCU 207 is determined at 296 to be forwardly oriented, its Neuron ID is stored as the first car 4, and the CCU responding is set to no-response mode. At test 298, if all CCU's 207 have not been identified and the orientation of their cars 4 determined, the loop 284 returns control to step 286. The loop 284 is repeated until all CCU's 207 which were identified in step 282 have been processed as to their sequential order and orientation. When that happens at 298, the manifest data is stored as a manifest data file at 302.

FIG. 12 illustrates the principal control functions of the system 201 in controlling the spreading of ballast 44 along the track 5. In the system 201, the length of surveyed track is divided into track unit lengths or "buckets". The size of the buckets is arbitrary; however, in an exemplary embodiment of the system 201, the buckets are equal to one foot lengths of the track 5. It should be noted that the type of ballast doors 40 employed in the present invention can be opened inboard or outboard or both ways simultaneously. Thus, if it is desired to spread ballast both between the rails and outside the rails, it is then necessary to track the activities in relation to two parallel sets of buckets, inboard buckets and outboard buckets. However, in some maintenance practices, particularly those in which subsequent activities involve lifting the rails and ties to position the deposited ballast, it is only necessary to spread outside the rails. For illustrative purposes, the system 201 will be described in terms of a single set of buckets.

In the ballast spreading control process 310 shown in FIG. 12, a bucket preparation and initialization set 315 receives the track survey data file 317 and the ballast train manifest data file 319. The manifest file 319 has been initialized with the average flow rate of ballast through the opened ballast doors at 321 and with the initial hopper ballast loads at 323. The bucket initialization step 315 also receives a user input target bucket quantity 325 which may actually be derived from a tons per mile entry. The target bucket quantity 325 is the amount of ballast per foot of a track to be applied in the spread zones 217. The bucket in no-spread zones 219 are initialized as full while the buckets in spread zones 217 are initialized at zero, or at another appropriate value if data has been inherited from a previous ballast spreading run. The process receives current geographic coordinate data 327 from the detector. Distances to each ballast door 40 are determined in relation to the train reference point coincident with the antenna detector 209.

The illustrated ballast spread control process 310 initiates a ballast spread control loop 330 at 100 millisecond or tenth of a second intervals, as shown by the wait step 332. During each loop 330, the HEC 205 determines a reference track position at 334, based on the location data, checks the state of all ballast doors 40 at 336, checks the state of buckets at 338 which can be affected by a door 40 currently being checked, updates all the door states at 340 by either maintaining the status quo or changing the state as required by conditions detected or calculated, updates all bucket states at 342 which have changed by addition of ballast 44. The control loop 330 continues until a test at 346 detects that the last bucket has been passed by the ballast train 3, at which point control exists at 348 from the ballast spread control process 310.

FIG. 13 shows additional details of the ballast spread control loop 330. As part of determining the current track position 334 at a clock tick 322, the current bucket number that the train reference 215 coincides with is determined at step 350 and a determination of the number of buckets moved since the last tick is made at 352. The steps 350 and 352 enable a determination of train speed and shifts the sets of buckets referenced at each door state check 336 (FIG. 12). The process 310 focuses on sets of buckets whose state of fill will be affected by the current state or potential change of state of a current ballast door 40 being checked.

The actual door state test at 354 determines if each ballast door 40 is currently open or closed. Depending on the detected state of the current door 40, the process 330 will enter a closed door loop 356 or an open door loop 358.

If the current door is closed, the closed door loop 356 checks a lookahead set of buckets at 360. The lookahead set of buckets are buckets positioned at such a distance ahead of the current door that, at the currently detected train speed and with the known response lag of the actuator 32, a change in door state "now" will begin to affect such lookahead buckets. The loop 356 considers a set of lookahead buckets since a given processing interval and train speed may so require. The set may also comprise a single bucket. The loop 356 calculates at 362 whether the current or actual fill of the test bucket plus a project fill from opening the current door would be less than the target fill for the bucket. If so, the current door 40 is opened 364; if not it stays closed at 366. All buckets in the current lookahead set are processed until a test at 368 determines that the last bucket has been processed. Afterwards, the loop 356 advances to the next door at 370.

If a door is detected as open at 354, the states of fill of a set of buckets which will receive ballast from the currently open door in the current clock tick interval are updated at 372. Afterward, the door open loop 358 is somewhat similar to the door closed loop 356 and includes a fill test 376 which determines if the actual fill of the lookahead buckets is less than the target fill. If not, that is the target is currently exceeded, the current door 40 is closed at 378. If the test 376 is true, the door stays open at 380. The lookahead loop exits at 382 when the last lookahead bucket for the current door 40 has been processed. Then the loop 358 proceeds to the next door at 384. When the last door has been checked, as indicated by the test 386, the process 330 waits for the next clock tick at 388.

The door open loop 358 allows some overfill of the buckets. As a practical track maintenance matter, this is preferable to not enough ballast available. However, it is highly undesirable to spread ballast in a no-spread zone 219, which may be a road crossing. Such an occurrence may constitute a road traffic hazard. For this reason, buckets in the no-spread zones always causes the current door 40 to be closed at 378.

The logic of the closed loop fill test 356 is designed to cause multiple ballast doors 40 to open if appropriate to quickly fill the desired buckets. It is desirable to maximize the number of filled buckets in the system 201 rather than partially fill a larger number of buckets.

As the ballast is depleted from hoppers 41, they are bypassed in processing and more rearward hoppers 41 are activated. Thus, ballast spreading proceeds from the forward hoppers 41 to the more rearward hoppers.

It is to be understood that while certain forms of the present invention have been illustrated and described herein, it is not to be limited to the specific forms or arrangement of parts described and shown.

Figure 16:
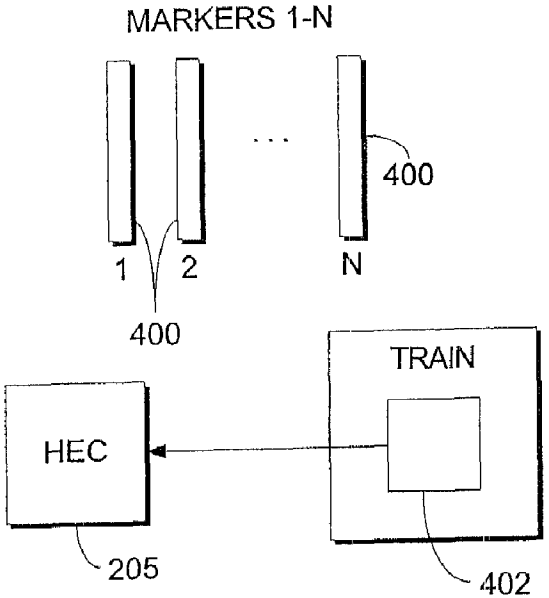
FIG. 16 is a diagrammatic view of an implementation of the present invention using wayside markers and manual detecting of them to obtain location and speed data.

FIG. 16 depicts an implementation constituting one technique for obtaining current train location and speed. A plurality of fixed wayside markers 400 are located at known positions along the railway. The markers 400 may be mile-markers that are commonly located along railroads at one mile intervals (or less in some cases). An input button 402 or another type of input device is located onboard the train and can be depressed or otherwise activated by an operator when he visually determines that the train has reached one of the markers 400. Each time one of the markers 400 is reached by the train, the button 402 is depressed, and it provides a signal to the HEC 205 each time it is depressed. Because the locations of the fixed markers 400 are known, the HEC is thus provided with information as to the location of the train along the railway. Additionally, the HEC clocks the time between successive depressions of the button 402 and uses this information to calculate the train speed. The HEC then activates the ballast application system to open and close the ballast doors 40 in a manner to discharge ballast to the railway bed where necessary, as previous described.

In this manner, the mile markers 400 are visually detected, and a manual signal is provided by way of the button 402 to the HEC 205 so that the HEC can activate the control system in a manner to open the ballast doors when a spread zone is encountered and close the doors at the end of the spread zone.

Figure 17:
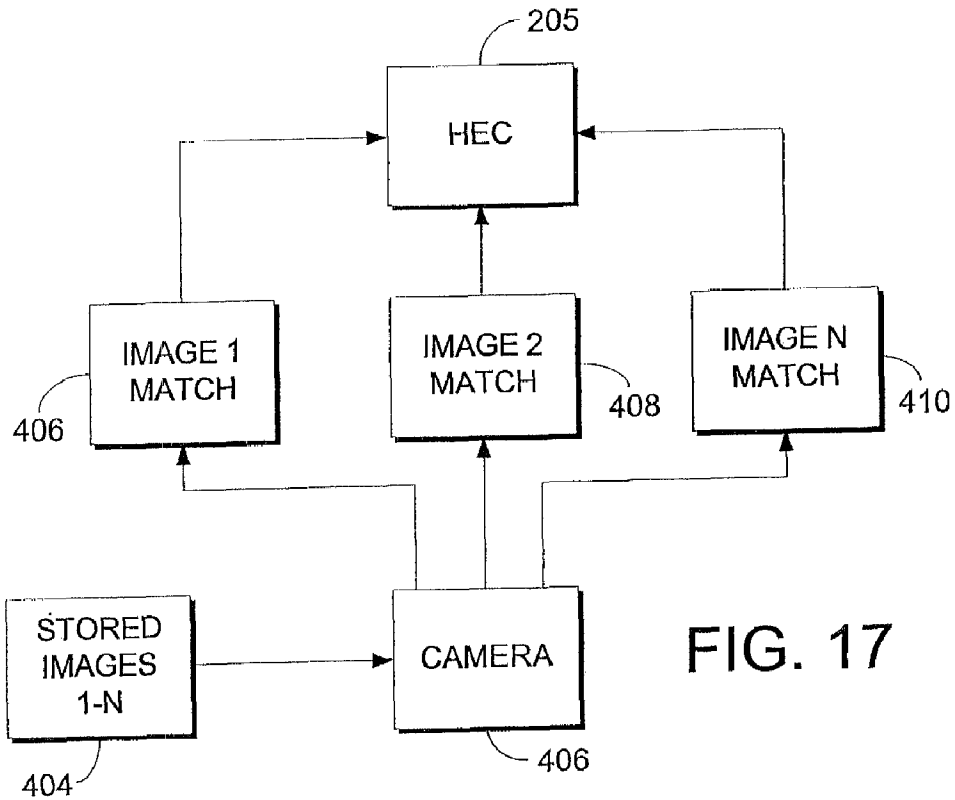
FIG. 17 is a diagrammatic view of an implementation of the invention using stored visual images and a visual recognition device to obtain location and speed data.

In accordance with the system shown in FIG. 17, a number of stored visual images 404 are recorded and stored at known locations along the railway. The stored images are provided to a camera 406 or another visual sensor device on board the train. As the train travels along the railway, the camera obtains current visual images and compares them with the stored images 404. When there is a match between a current image and a stored image, as indicated by blocks 406, 408 and 410, the HEC 205 is signaled and thus becomes aware of the current location of the train. Also, the HEC 205 can calculate the train speed by clocking the time between successive matches with the stored images. The HEC then controls the application of ballast by opening the ballast doors in spread zones and closing the ballast doors when the spread zones have been traversed.

Figure 18:
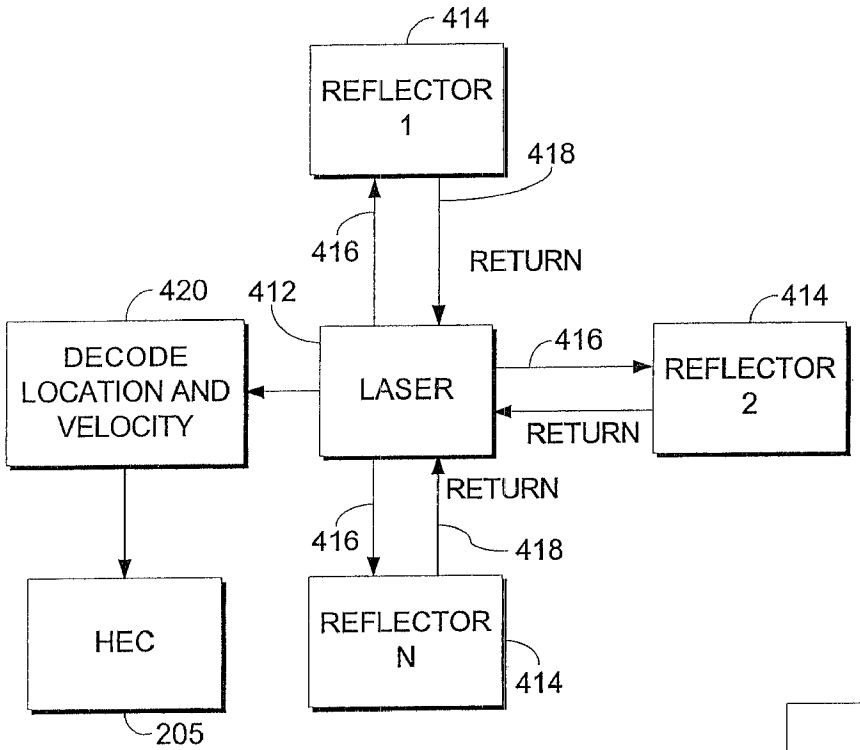
FIG. 18 is a diagrammatic view of an implementation of the invention using wayside reference points and laser techniques to obtain location and speed data.

FIG. 18 depicts a modified system that makes use of an onboard laser 412 to obtain distance and speed information of the train. A series of reflectors 414 are spaced apart at known locations along the railway. The laser generates laser beams 416. When these beams are intercepted by one of the reflectors 414, a return beam 418 is reflected back to the laser 412. The return signals 418 are decoded by suitable decode circuitry 420 using the time delay between the transmitted and return signals and the frequency shift to determine the current distance to each reflector 414 and the train velocity. This location and speed information is provided by the circuitry 420 to the HEC 205. The HEC 205 then operates the ballast doors in a manner to apply the required amount of ballast to the ballast spread zones and discontinue the spreading when the end of each spread zone has been reached.

Figure 19:
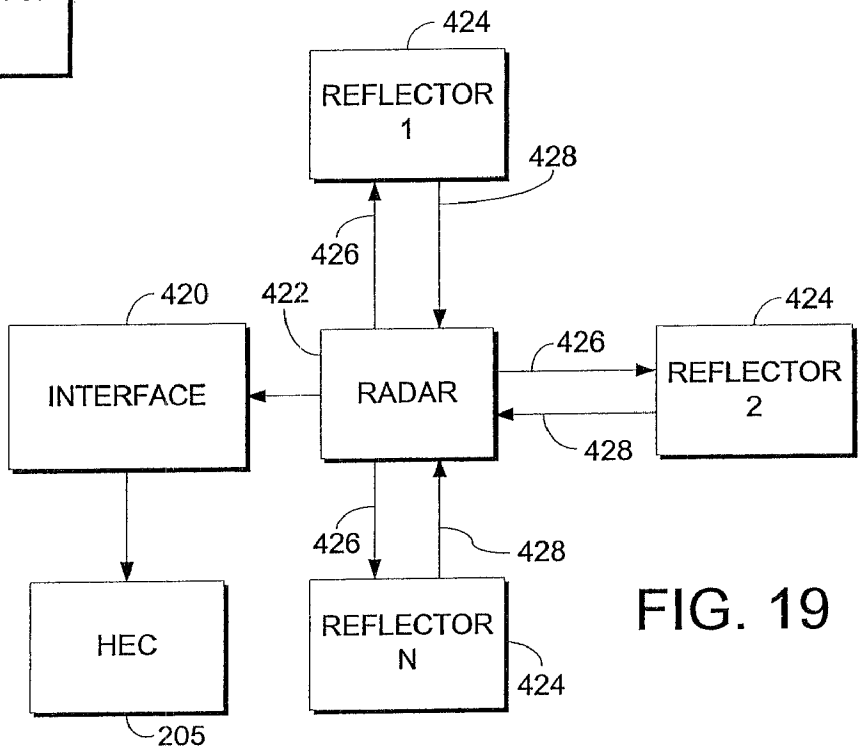
FIG. 19 is a diagrammatic view of an implementation of the invention using radar techniques to obtain location and speed data.

FIG. 19 depicts diagrammatically an alternative system that makes use of an onboard radar device 422 which may be of the type commonly used on roadways and the like by law enforcement organizations. A plurality of reference points 424 are established along the roadway at fixed and known locations. The radar device 422 transmits radar signals 426.

These signals are reflected as return signals 428 by the reference points 424 and received by the radar device 422. A suitable interface 430 can be provided to the HEC 205. The radar device 422 uses the return signals 428 to determine the current location and speed of the train, and this information is provided to the HEC 205 through the interface 430. The HEC then controls the hopper doors in order to apply ballast to the spread zones in the manner described previously.

Figure 20:
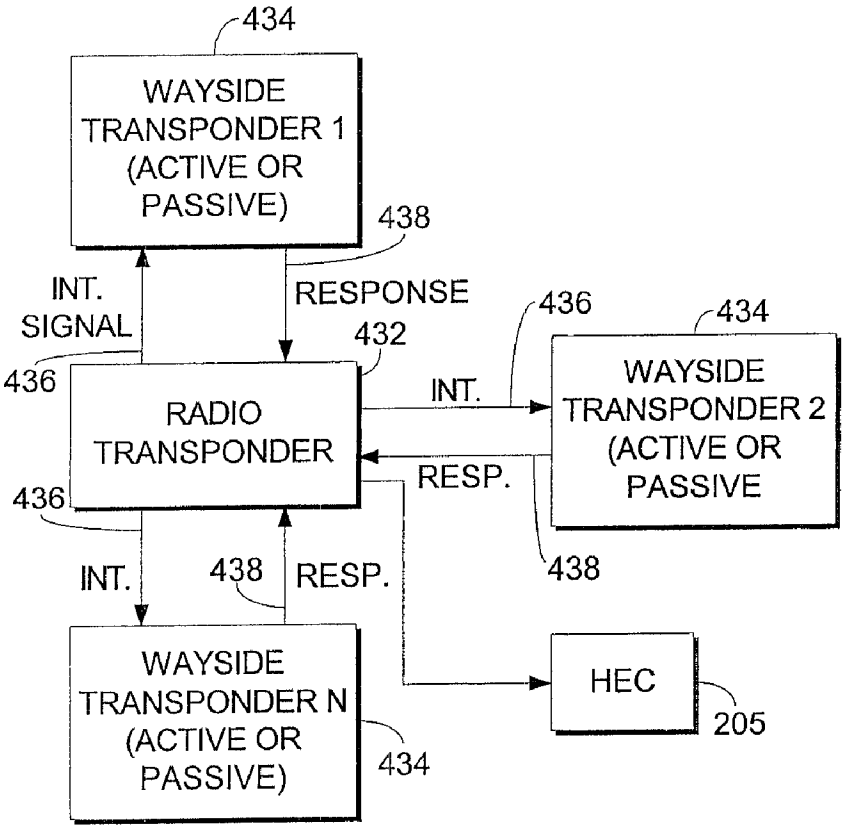
FIG. 20 is a diagrammatic view of an implementation of the invention using onboard and wayside radio frequency transponders to obtain location and speed data.

With reference to FIG. 20, the train can be provided with an onboard radio frequency transponder 432. Wayside radio frequency transponders 434 can be provided at known locations along the railway. The onboard transponder 432 transmits RF interrogation signals 436. When one of the signals 436 is picked up by a wayside transponder 434, that transponder sends an RF response signal 438 to the onboard transponder 432. The response signals 438 can be used by the transponder 432 to determine the current location of the train as well as its velocity. The onboard radio transponder provides the location and velocity information to the HEC 205 so that the HEC can control the ballast doors in a manner to apply ballast sufficient to make up the deficiency in each spread zone.

The wayside transponders 434 can be either active or passive devices. If the transponders 434 are active devices, they require battery power or external power for operation. Such devices can be effective at distances in excess of one mile. Using passive transponders 434 has the advantage of being inexpensive and requiring no external power.

The radiated power received by the interrogation signals 436 can be used by passive transponders for transmission of the response signals 438. However, the range of such a passive device is typically between 15 and 50 feet for reliable operation.

Figure 21:
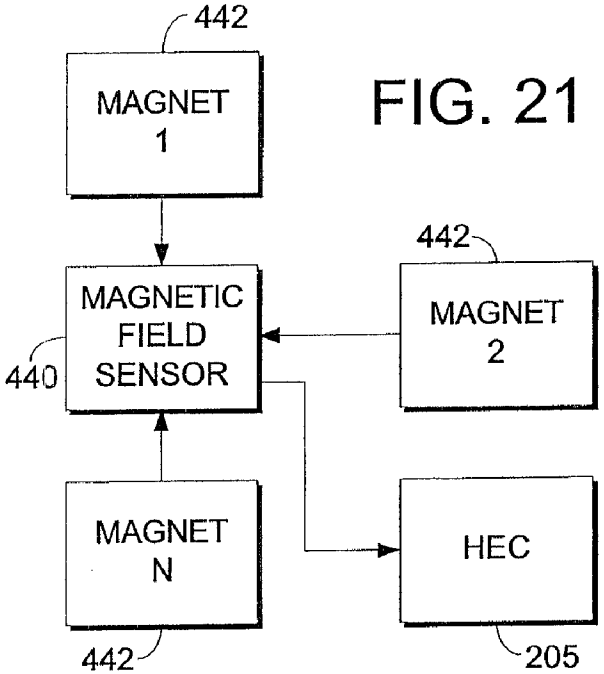
FIG. 21 is a diagrammatic view of an implementation of the invention using magnetic referencing techniques to obtain location and speed data.

FIG. 21 depicts a system that makes use of magnetic techniques to obtain the train location and speed. A suitable sensor 440 is carried on the train and is sensitive to variations in the ambient magnetic field. Magnets 442 can be placed along the railway or rail bed at known locations such that the sensor provides a signal to the HEC 205 each time one of the magnets 442 is encountered by the train. The HEC thus keeps track of the location of the train through signaling from the sensor 440 and can calculate the train speed by taking into account the time between successive signals. The HEC then controls the ballast doors in the manner previously described to apply ballast to spread zones in the proper amounts.

The sensor 440 can instead make use of variations in the earth's magnetic field at known locations along the rail bed.

This type of sensor requires high sensitivity in order to interpret variations in the magnetic field of the earth reliably enough to provide dependable location information. Further, the effects of the rotation of the earth and gravitational disturbances from the moon need to be taken into account, along with other minute disturbances that can occur. However, such a system has the advantage that there is no need to place magnetic devices or other wayside devices along the railway.

Figure 22:
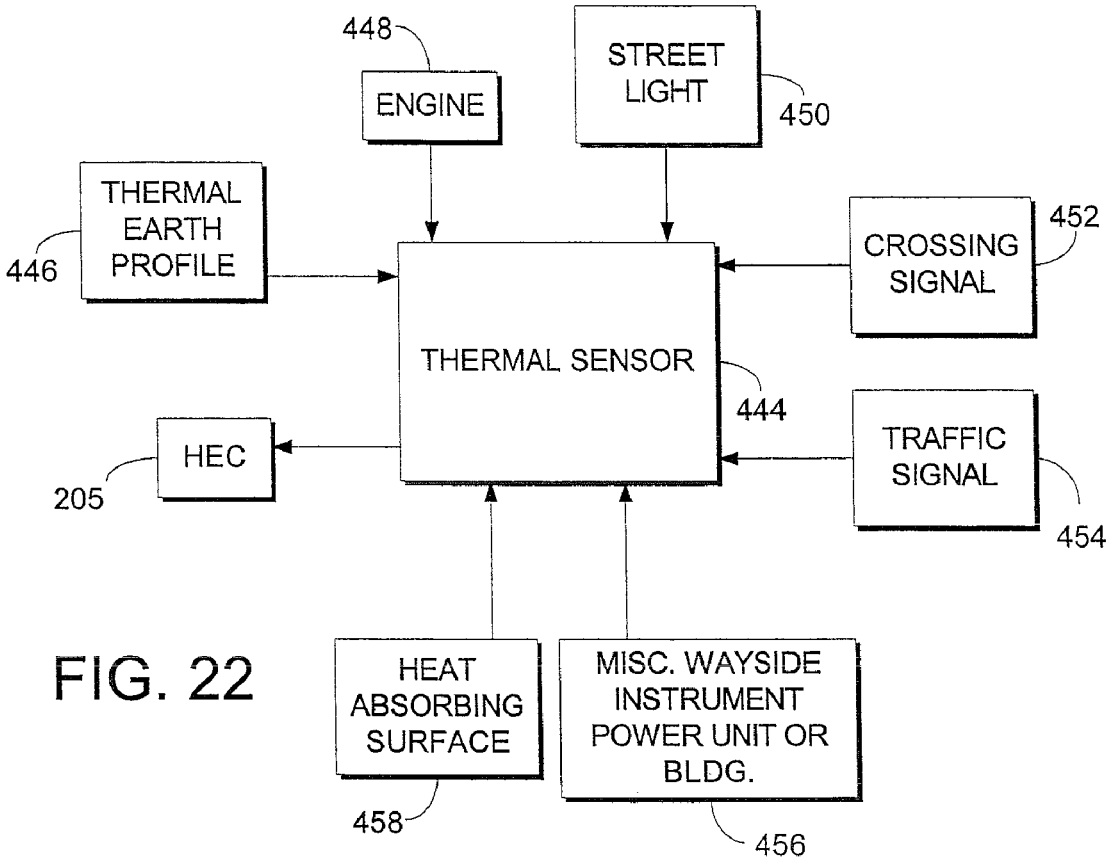
FIG. 22 is a diagrammatic view of an implementation of the invention using thermal sensing techniques to obtain location and speed data.

Thermal sensing techniques can also be used. FIG. 22 illustrates a system in which a thermal sensor 444 is mounted on the train. The sensor 444 may be provided with a reference thermal profile along the railway. As the train moves along the railway, the sensor 444 senses the current terminal profile along the railway, as indicated at 446. By comparing the current thermal profile with the reference profile, the sensor 444 can detect the current location of the train and provide the location information to the HEC 205. The HEC can compute the train velocity by taking into account the time required to move between different known locations along the railway.

Alternatively, the sensor 444 can make use of man made thermal devices that are located along the railway. For example, a heat generating engine 448 may be located at a known position along the railway. Street lights 450, crossing signals 452, traffic signals 454 and other miscellaneous wayside instrumentation, power units or buildings at known locations may also be sensed by sensor 444 and used to determine the train location. A particularly strong heat absorbing surface 458 along the railway may also be sensed to determine the train location.

Figure 27:
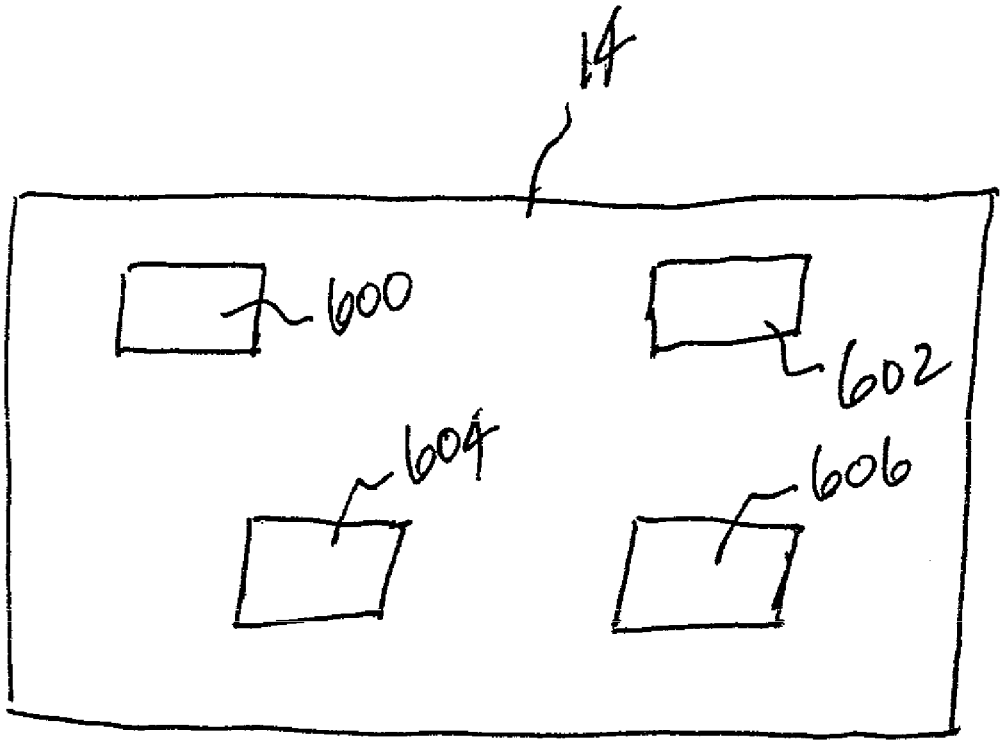
FIG. 27 is a diagrammatic depiction of an inertial system and components thereof which may be used in accordance with the invention.

The ballast spread zones are marked by an integrated GPS system as described, and the inertial system 14 serves as a backup system to the GPS system. As shown in FIG. 27, the inertial system 14 includes a fiber optic gyroscope 600, a series of accelerometers 602, tilt sensors 604, and a Doppler sensor 606. The inertial system 14 serves as a backup system to the GPS system and produces latitude and longitude coordinates in situations when a GPS signal is not received, such as when the train is in a tunnel.

The fiber optic gyroscope 600 detects changes in heading using known gyroscopic techniques and instrumentation. The accelerometers 602 act to detect changes in acceleration and deceleration. The tilt sensors 604 detect changes in vertical position perpendicular to the rails along which the train travels. The Doppler sensor 606 provides a wireless means for detecting the ground speed of the train.

These sensors and/or systems may be used together in various combinations or separately and independently to accurately and repeatedly mark spread zones along the railway and control the application of ballast to spread zones.

Figure 23:
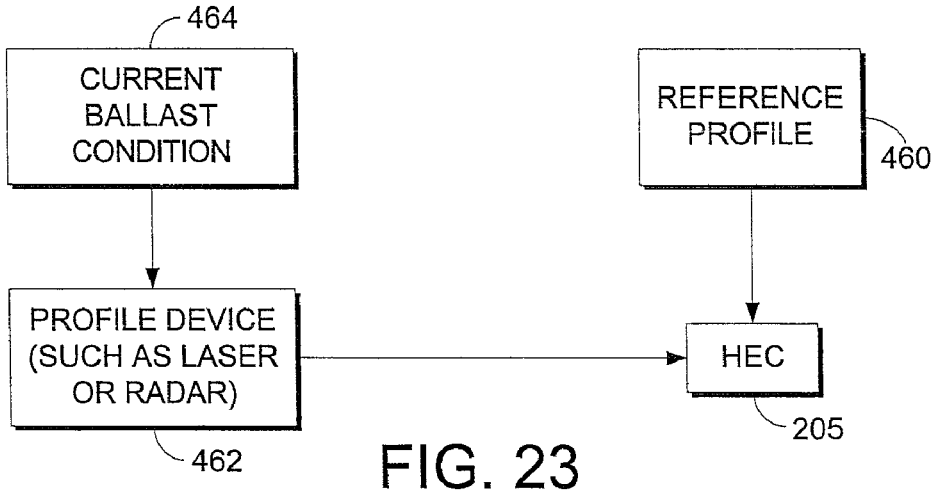
FIG. 23 is a diagrammatic view of an implementation of the invention wherein a profile device is used to obtain a current ballast profile along the railway bed for comparison with a reference ballast profile to detect areas of ballast deficiency.

The present invention also contemplates a unique method and apparatus for surveying a railway bed. With reference to FIG. 23, this survey technique makes use of a reference profile of the terrain along the railway bed. A profiling device such as a laser or radar can be used to obtain the reference terrain profile 460. The reference profile 460 represents an ideal ballast condition. A survey vehicle travels along the track carrying a profile device 462 which may be a device such as a laser or radar. The profile device 462 obtains a profile of the current ballast condition 464 and provides that information to the HEC 205. The current ballast condition can be compared by suitable software with the reference profile to determine the location of each spread zone in which there is ballast deficiency, and the extent of the deficiency at each spread zone. In this manner, the location of each spread zone can be determined by the survey and stored so that the ballast spreading train can then travel along the railway and apply ballast in the necessary amount to make up the deficiency in each spread zone.

The present invention further contemplates a manual ballast application system in which the survey and application are done "on the fly". In a system of this type, the group of interconnected rail cars are transported along the railway. A trained operator on board the train visually detects when a zone along the railway bed that is being approached by the train is deficient in ballast, along with the location of the zone and the extent of the ballast deficiency. The operator then signals the HEC 205 that a spread zone is being approached and provides information as to its location and the extent of the ballast deficiency. The controller then operates in the manner described previously to open or partially open at least one of the ballast doors when the no spread zone location is reached in order to discharge ballast at a rate sufficient to make up the deficiency of ballast at the spread zone. When the end of the spread zone is reached, the door is closed in order to discontinue the application of ballast to the railway pad.

Because the survey and application are combined using this technique, considerable time and expense are saved. However, relatively high level personnel are normally required to assure accuracy in the calling out of the spread/no spread zones along with the application rate requirements. Such a system finds its greatest utility in low risk spreading areas such as areas where there is an absence of no spread zones.

Figure 24:
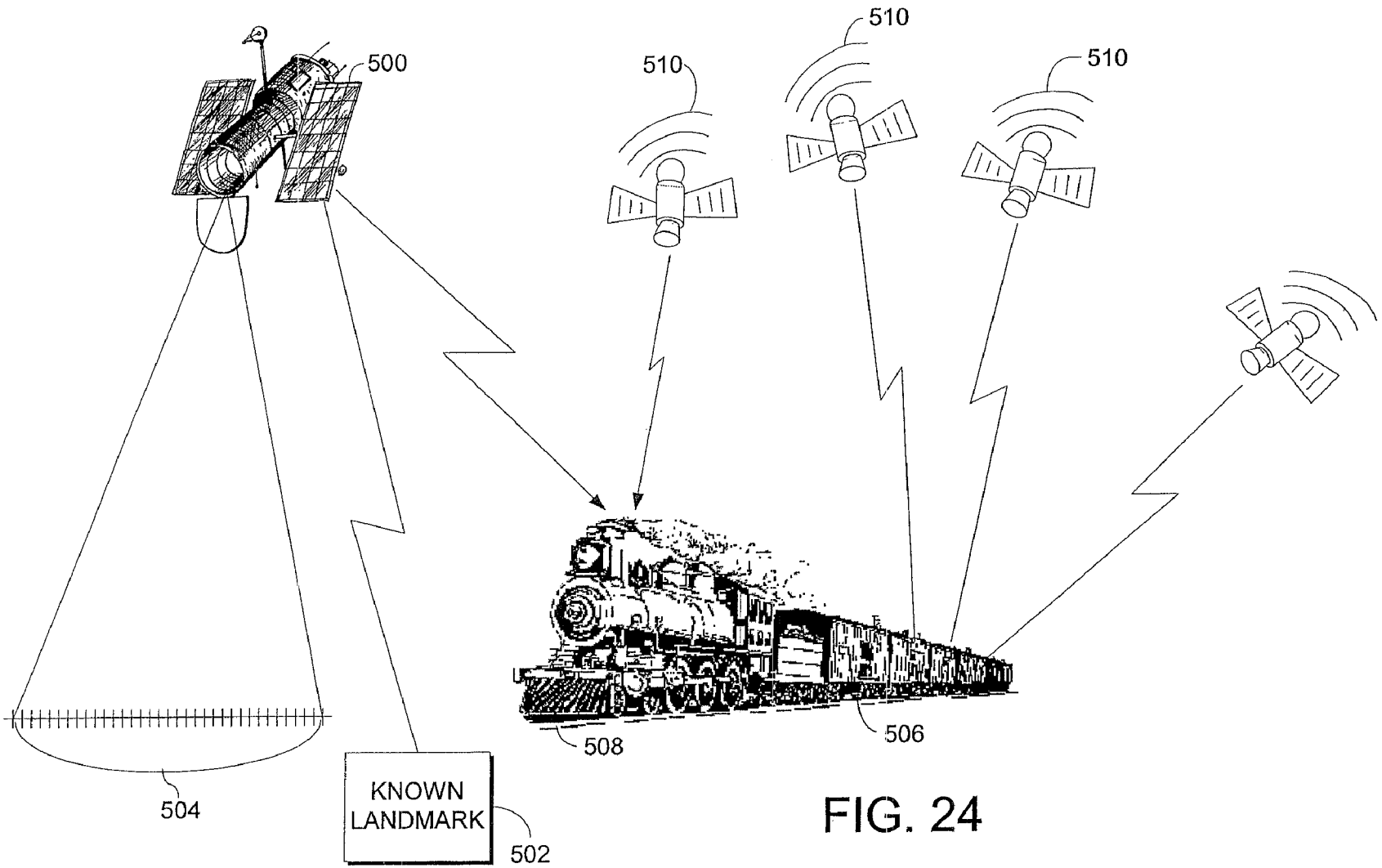
FIG. 24 is a diagrammatic view of an implementation of the invention making use of aerial photogrammetry utilizing satellite imagery to survey railway bed conditions.
Figure 25:
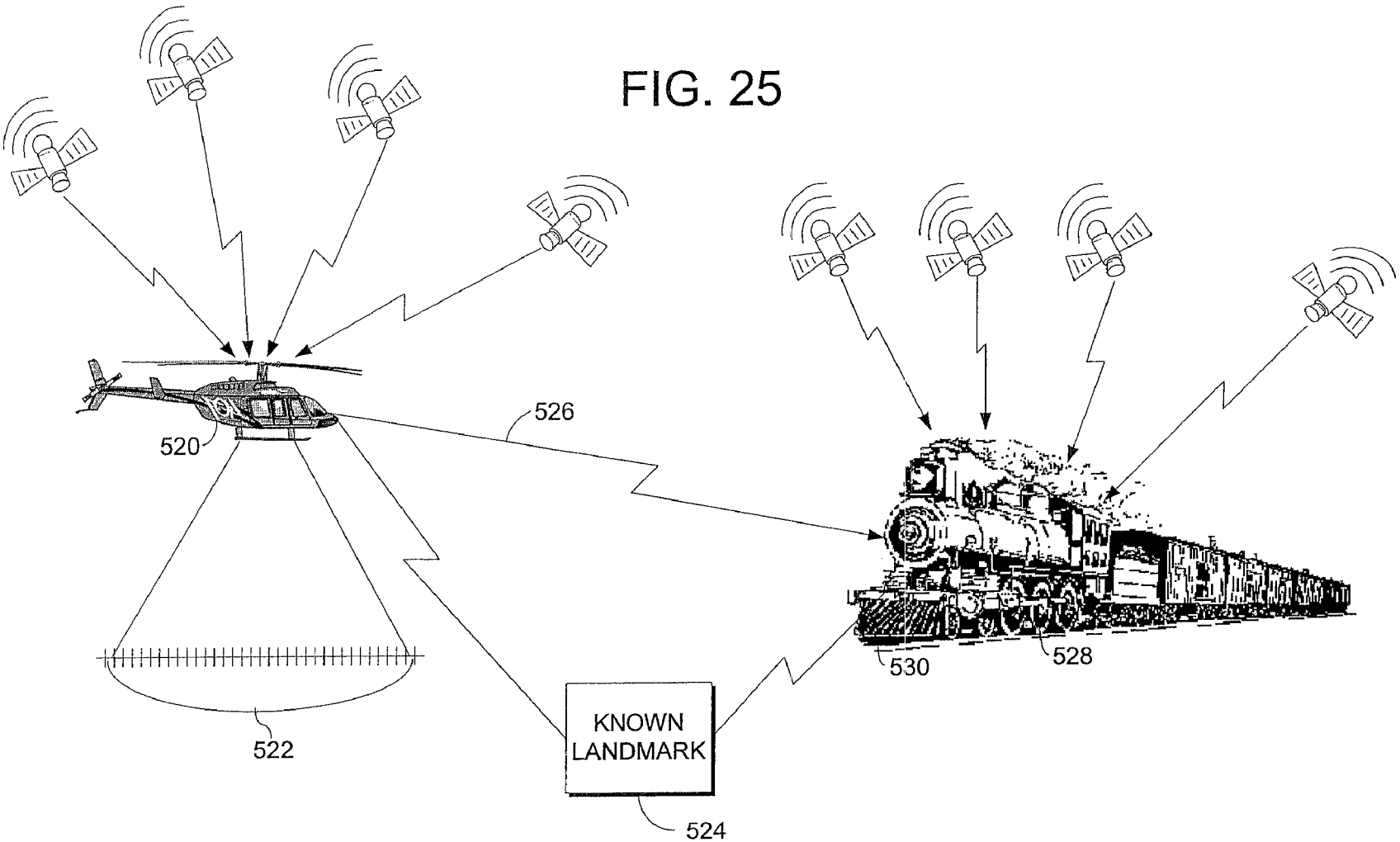
FIG. 25 is a diagrammatic view of an implementation of the invention making use of manned aircraft for aerial photogrammetry.
Figure 26:
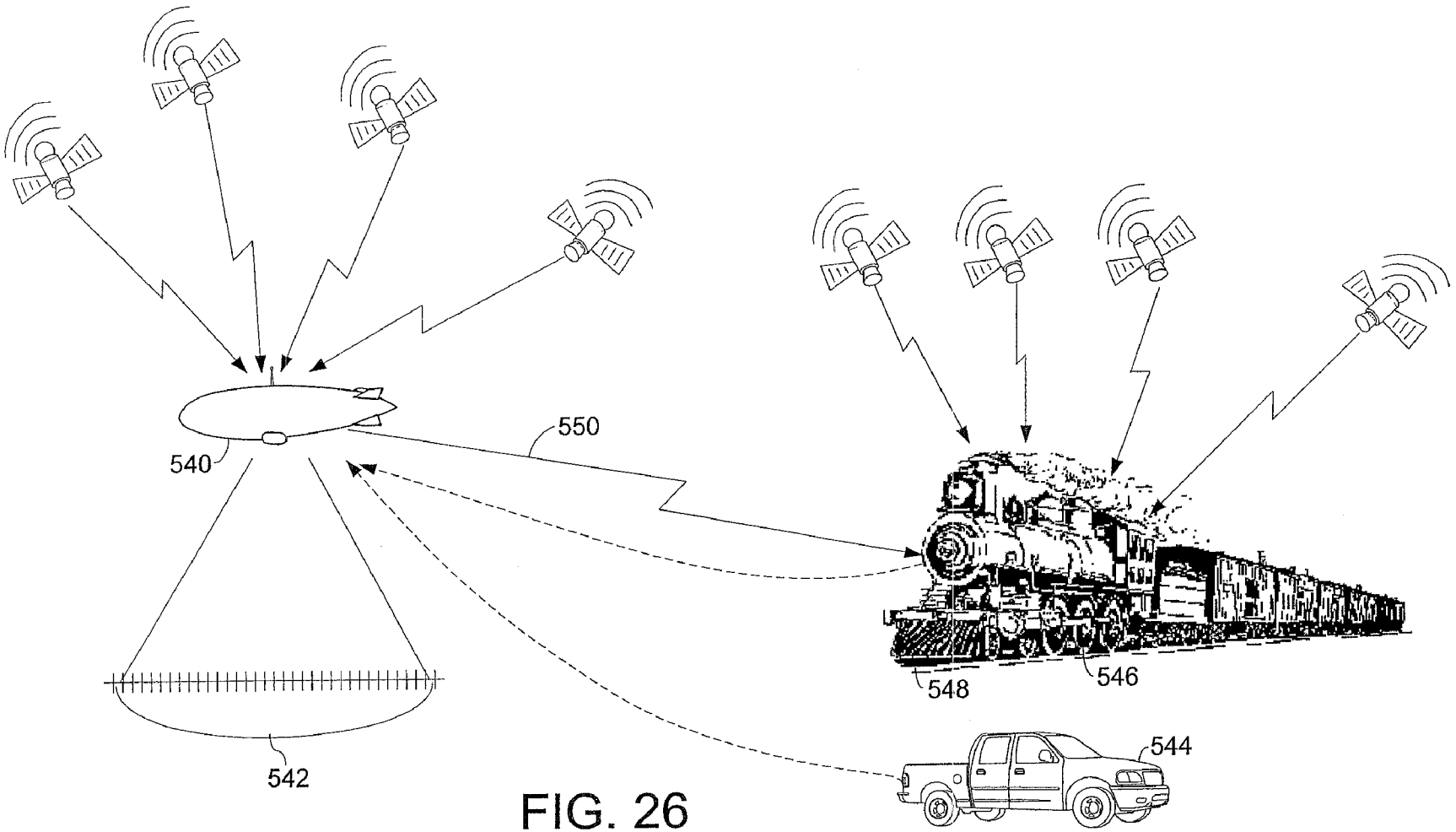
FIG. 26 is a diagrammatic view of an implementation of the invention making use of an unmanned aerial vehicle for aerial photogrammetry.

FIGS. 24-26 depict implementations of the invention that make use of aerial photogrammetry. In accordance with these embodiments of the invention, indications of areas along the railway bed that are deficient in ballast are determined by obtaining high resolution images of the railway from airborne locations.

Referring first to FIG. 24, a satellite 500 makes use of high technology photogrammetry having sufficient resolution to allow recognition of railway bed characteristics. By way of example, the satellite 500 may use known imaging technology to determine the location of a known landmark 502. A DGPS grid 504 may be overlaid on a known location either at or a known distance from the landmark 502. In this manner, the location of spread and no spread zones can be accurately identified, as can other railway conditions such as the location of track equipment, bridges, crossings and the like. Image updates can be determined by orbital satellite speed or by camera rotation speed for geostationary satellites. Restrictions can occur due to cloud cover or other atmospheric conditions, but even then, satellite imaging can be used as an effective backup for other surveying, including ground based surveying.

The ballast train 506 carrying one or more railcars that are operable to spread ballast in the manner previously described travels along a railway bed 508. The train 506 obtains GPS information from a constellation of GPS satellites 510 and differential GPS correction information as an option.

Images that are captured at an airborne location by the satellite 500 with information indicating the location of the images can be directly transmitted to the ballast train 506, and the onboard computer in the train 506 can automatically recognize track and roadbed requirements using image recognition.

Alternatively, the image information can be transmitted to a base station (not shown) where a more thorough analysis of the information can be performed. The base station can then transmit the analyzed information to the train that is used for spreading of ballast.

In this manner, the ballast train 506 is provided with accurate and reliable information as to locations of ballast spread zones that are deficient in ballast. Train 506 can then discharge ballast at the no spread zones as the railcars that carry the ballast are transported over the no spread zones. The image information captured by the satellite 500 can be used to determine the amount of ballast that needs to be applied in order to make up the deficiency in each zone that has a ballast deficiency. Consequently, the correct amount of ballast is discharged at the proper locations to make up for any deficiencies that are present along the railway bed 508.

With reference to FIG. 25, aerial photogrammetry can also be implemented using manned aircraft such as the rotary winged aircraft 520 (or a fixed wing aircraft if desired). The manned aircraft 520 receives GPS information and makes use of a DGPS generated position grid 522 that may be located at or a known distance from a fixed landmark 524. The aircraft 520 captures real time photogrammetric data using photographic images in the DGPS grid 522. Analysis of the image and position data may be done onboard the aircraft using image recognition along with operator modifications or other techniques if necessary. In this fashion, the manned aircraft 520 determines the locations of ballast spread zones that are deficient in ballast. This information can be transmitted as indicated at 526 to a ballast spreading train 528 traveling along a railway bed 530. Alternatively, the information can be transmitted from the aircraft 520 to an earth based station which then transmits the information to the ballast train 528.

Using this technique, ballast train 520 can apply ballast from the railcars to each of the no spread zones that are deficient in ballast, and the correct amount of ballast can be applied in each instance.

Other photogrammetric methods can be used for survey data collection, including a remotely piloted vehicle (RPV) or an unmanned aerial vehicle (UAV) such as the vehicle 540 shown in FIG. 26. Use of a UAV (or RPV) provides close up observations of the railway conditions without the heavy payload requirement demanded by manned aerial vehicles. UAV 540 (or RPV) can receive GPS and differential GPS correction information. The use of alignment and orientation techniques allow the UAV 540 to compare this information to the graphic imagery collected from cameras that are onboard the vehicle 540. Previously collected data can be used to establish reference points, and a DGPS grid 542 can also be used. The UAV 540 uses multiple data collection means to achieve its goal of data collection in either sunny or inclement weather. Among the techniques that can be used are laser or lidar, infrared, radar, and photogrammetry. The use of these techniques allows operation at all times of the day and in all but extreme conditions.

The UAV 540 (or RPV) may be sent out to survey the railway bed from a launching facility which may be the bed of truck 544 or a railcar formed as part of the ballast train 546. The flight of the vehicle 540 is directed by the onboard computer in the ballast train or another land based vehicle such as the truck 540 or another land base. The vehicle 540 has geographical information stored onboard as well as automated flight control equipment that insures complete autonomy in data collection. It can also be monitored by a ground based system for flight course modifications or emergency situations.

The vehicle 540 obtains resolution images that provide information as to the locations of ballast spread zones along the railway bed 548 so that the ballast train 546 can apply the needed ballast to each ballast spread zone in the manner described previously. It is contemplated that information as to the locations of the ballast spread zones and the images captured by the vehicle 540 will be transmitted directly to the train as indicated at 550. The information can be analyzed and used by the train 546 for the accurate application of ballast.

Unmanned vehicle 540 can be recovered by directing it to a landing facility using a predetermined landing sequence. Direct recovery from the launching vehicle 544 or other launching facility can also be implemented.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

The invention claimed is:

1. Apparatus for applying ballast to a bed of a railway having a ballast deficient zone occupying a preselected span along the railway having first and second ends using a railcar that carries ballast and has a ballast door which can be opened to discharge ballast to the bed and closed to prevent ballast discharge as the railcar travels along the railway, said apparatus comprising:

a plurality of radar reflective reference locations along the railway each a known predetermined distance from said ballast deficient zone;

a radar transmitter on the railcar for directing a radar signal toward each reference location that is approached by the railcar;

a radar receiver on the railcar for receiving a reflected radar signal reflected from each reference location;

means for determining the current location of the railcar relative to each reference location based on the reflected radar signal to thereby determine the current distance of the railcar from said ballast deficient zone;

means for determining the current distance of the railcar from said first and second ends of said ballast deficient zone using said current location of the railcar;

means for detecting when the current distance of the railcar from said first end of said ballast deficient zone is equal to zero;

means for opening said ballast door to initiate discharge of ballast from the railcar when the current distance of the railcar from said first end of said ballast deficient zone is approximately equal to zero;

means for maintaining said ballast door open to continue discharging the ballast from the railcar while the railcar traverses said span from said first end to said second end;

means for detecting when the current distance of the railcar from said second end of said ballast deficient zone is equal to zero; and means for closing said ballast door to terminate discharge of ballast from the railcar when the current distance of the railcar from said second end of said ballast deficient zone is approximately equal to zero.

2. Apparatus for applying ballast to a bed of a railway having a ballast deficient zone occupying a preselected span along the railway having first and second ends using a railcar that carries ballast and has a ballast door which can be opened to discharge ballast to the bed and closed to prevent ballast discharge as the railcar travels along the railway, said apparatus comprising:

a thermal sensor carried on the railcar for sensing thermal characteristics of the bed which are at predetermined distances from said first and second ends of said ballast deficient zone in a manner to determine the current distance of the railcar along said railway from said first and second ends of said ballast deficient zone; and means for opening said ballast door to initiate discharge of ballast from the railcar when the current location of the railcar as determined by said thermal sensor corresponds to said first end of said ballast deficient zone;

means for maintaining said ballast door open to continue discharge of ballast from the railcar when the current location of the railcar as determined by said sensor thermal corresponds to any position between said first and second ends of said ballast deficient zone; and means for closing said ballast door to terminate discharge of ballast from the railcar when the current location of the railcar as determined by said thermal sensor corresponds to said second end of said ballast deficient zone.

* * * * *